US012420850B2

(12) United States Patent
Kernwein et al.

(10) Patent No.: US 12,420,850 B2
(45) Date of Patent: Sep. 23, 2025

(54) VEHICLE CONTROL SYSTEM

(71) Applicant: Transportation IP Holdings, LLC, Norwalk, CT (US)

(72) Inventors: Jeffrey D. Kernwein, Cedar Rapids, IA (US); Jeremy Blackwell, Cedar Rapids, IA (US); James D. Brooks, Schenectady, NY (US); Hullas Sehgal, Niskayuna, NY (US)

(73) Assignee: Transportation IP Holdings, LLC, Norwalk, CT (US)

( * ) Notice: Subject to any disclaimer, the term of this patent is extended or adjusted under 35 U.S.C. 154(b) by 294 days.

(21) Appl. No.: 18/312,804

(22) Filed: May 5, 2023

(65) Prior Publication Data

US 2023/0271637 A1 Aug. 31, 2023

Related U.S. Application Data

(63) Continuation-in-part of application No. 17/315,836, filed on May 10, 2021, now Pat. No. 11,691,656, (Continued)

(51) Int. Cl.
*B61L 23/34* (2006.01)
*B61L 15/00* (2006.01)
(Continued)

(52) U.S. Cl.
CPC ..... *B61L 23/34* (2013.01); *B61L 15/0062* (2024.01); *B61L 23/007* (2013.01); *B61L 25/021* (2013.01);
(Continued)

(58) Field of Classification Search
CPC ..... B61L 23/34; B61L 27/16; B61L 15/0058; B61L 5/0062; B61L 3/16; B61L 15/0009;
(Continued)

(56) References Cited

U.S. PATENT DOCUMENTS 5,554,982 A * 9/1996 Shirkey ..... B61L 15/0092 340/901
7,593,963 B2 9/2009 Ballesty et al.
(Continued)

FOREIGN PATENT DOCUMENTS

| | | |
|---|---|---|
| CA | 2630045 A1 | 6/2007 |
| CA | 2617670 A1 | 7/2008 |
| JP | 3022759 B2 | 1/2000 |

*Primary Examiner* — Calvin Cheung
(74) *Attorney, Agent, or Firm* — K&L Gates LLP

(57) ABSTRACT

A system and method can include determining a location of a locating device disposed onboard a vehicle system, identify a size of the vehicle system, calculate a duration that the vehicle system has been blocking or will be blocking an intersection between at least two intersecting routes based at least in part on the location of the locating device and on the size of the multi-vehicle system, and implement one or more responsive actions to clear the intersection responsive to the calculation of the duration. Optionally, the system and method can predict or forecast whether a vehicle system approaching or moving through the intersection will come to a stop in a locking that blocks the intersection, and implement one or more responsive actions.

20 Claims, 10 Drawing Sheets

Related U.S. Application Data which is a continuation of application No. 16/263,870, filed on Jan. 31, 2019, now Pat. No. 11,008,029, which is a continuation-in-part of application No. 15/705,752, filed on Sep. 15, 2017, now Pat. No. 10,246,111, which is a continuation of application No. 15/061,212, filed on Mar. 4, 2016, now Pat. No. 9,764,748.

(60) Provisional application No. 62/281,429, filed on Jan. 21, 2016.

(51) Int. Cl.

| | |
|---|---|
| ***B61L 23/00*** | (2006.01) |
| ***B61L 25/02*** | (2006.01) |
| *B61L 3/16* | (2006.01) |

(52) U.S. Cl.
CPC ..... *B61L 25/025* (2013.01); *B61L 3/16* (2013.01); *B61L 15/0009* (2013.01); *B61L 2205/04* (2013.01)

(58) Field of Classification Search
CPC .... B61L 23/007; B61L 25/021; B61L 25/025; B61L 2205/04
See application file for complete search history.

(56) References Cited

U.S. PATENT DOCUMENTS

| | | | | |
|---|---|---|---|---|
| 9,764,748 | B2 | 9/2017 | Brooks et al. | |
| 10,246,111 | B2 | 4/2019 | Brooks et al. | |
| 11,008,029 | B2 | 5/2021 | Brooks et al. | |
| 11,691,656 | B2 | 7/2023 | Brooks et al. | |
| 2002/0056579 | A1 | 5/2002 | Cooper | |
| 2003/0111282 | A1 | 6/2003 | Landes | |
| 2003/0122039 | A1 | 7/2003 | Mollet et al. | |
| 2004/0015275 | A1 | 1/2004 | Herzog et al. | |
| 2004/0230354 | A1 | 11/2004 | Sollars et al. | |
| 2005/0109548 | A1 | 5/2005 | Cooper et al. | |
| 2008/0099633 | A1 | 5/2008 | Kane et al. | |
| 2008/0128562 | A1 | 6/2008 | Kumar et al. | |
| 2009/0299555 | A1 | 12/2009 | Houpt et al. | |
| 2011/0202212 | A1 | 8/2011 | Gatten et al. | |
| 2011/0315043 | A1 | 12/2011 | Kumar | |
| 2012/0001767 | A1 | 1/2012 | Ballinger | |
| 2013/0018534 | A1* | 1/2013 | Hilleary | B61L 29/30 701/19 |
| 2013/0200222 | A1 | 8/2013 | Cooper | |
| 2013/0214097 | A1 | 8/2013 | Graber | |
| 2013/0299645 | A1 | 11/2013 | Cooper et al. | |
| 2014/0166820 | A1 | 6/2014 | Hilleary | |
| 2014/0361125 | A1 | 12/2014 | Fries et al. | |
| 2014/0367526 | A1* | 12/2014 | Steffen, II | B61L 25/021 246/126 |
| 2016/0318532 | A1 | 11/2016 | Brooks et al. | |
| 2017/0096154 | A1 | 4/2017 | Hurst | |

* cited by examiner

800

| 802 Vehicle System | 804 HPT | 806 Rank |
|---|---|---|
| 702A | 2.0 | 4 |
| 702B | 3.0 | 2 |
| 702C | 2.5 | 3 |
| 702D | 1.5 | 5 |
| 702E | 4.0 | 1 |

VEHICLE CONTROL SYSTEM

CROSS-REFERENCE TO RELATED APPLICATIONS

This application is a continuation-in-part of U.S. patent application Ser. No. 17/315,836 (filed 10 May 2021), which is continuation of U.S. patent application Ser. No. 16/263,870 (filed 31 Jan. 2019, issued as U.S. Pat. No. 11,008,029), which is a continuation-in-part of U.S. patent application Ser. No. 15/705,752 (filed 15 Sep. 2017, issued as U.S. Pat. No. 10,246,111), which is a continuation of U.S. patent application Ser. No. 15/061,212 (filed 4 Mar. 2016, issued as U.S. Pat. No. 9,764,748), which claims priority to U.S. Provisional Application No. 62/281,429 (filed 21 Jan. 2016). The entireties of these applications are incorporated herein by reference.

FIELD

Embodiments of the subject matter described herein relate to vehicle control systems, and more particularly, to controlling a vehicle system relative to other vehicles, crossings or intersections, and/or work zones.

BACKGROUND

A vehicle transportation system may include multiple vehicle systems that travel on the same routes. These vehicle systems may be formed from a single vehicle or multiple vehicles. The vehicle systems may have different characteristics, such as power outputs and weights, that affect how quickly the vehicles can navigate through the routes. A trailing vehicle system traveling along a given route may reduce the distance between the trailing vehicle system and a vehicle system ahead along the same route that travels slower. The trailing vehicle system has an incentive to reduce the total trip time to meet a designated arrival time at a destination, improve fuel economy, reduce emissions, and the like. However, if the trailing vehicle system travels too closely to the vehicle system ahead, the trailing vehicle system may be required to slow to a stop for a designated duration (e.g., designated period of time) to avoid or reduce a risk of an accident between the vehicle system. The stop may be undesirable as the stop may result in a significant delay and reduce fuel economy.

At least some of the routes over which vehicle system travel may cross routes of other transportation systems, such as where rail tracks, roads, highways, or other routes cross over each other, intersect each other, or merge with each other (referred to herein as crossings or intersections). To warn the vehicle system of the other transportation systems, a vehicle system approaching an intersection may activate a warning sound that is audible to people and animals near the crossing. Typically, the operator of a vehicle system controls the warning sound in addition to other duties of the operator. It is not uncommon for the operator to make mistakes, such as forgetting to activate the warning sound at the proper time, activating the warning sound when not warranted (e.g., when the vehicle system is in a quiet zone), or the like.

Additionally, vehicle systems may stop in locations that cause a crossing to be blocked. For example, very long rail vehicle systems may stop in a location that results in a leading end locomotive being ahead or otherwise outside of the crossing, but one or more trailing locomotives or railcars may be disposed in (and thereby blocking) the crossing. As another example, other vehicle systems, such as trucks or automobiles pulling trailers, may stop in locations that block a crossing. As another example, multiple vehicle systems that are separate from each other but traveling through a crossing can end up blocking the crossing if a vehicle system at the leading end of these vehicle systems stops in a location that results in the other vehicle systems stopping in and blocking the crossing (e.g., an automobile may stop or break down and cause a resulting traffic buildup behind the automobile, which can block the crossing). In addition to actual blocking, overly slow approaches to a crossing by one vehicle may cause another vehicle to try to avoid crossing barriers so as to cross and avoid the wait.

Crossings can be blocked with an actual obstruction (of another vehicle) or by the signal system initiated in response to an incoming vehicle. A blocked crossing can cause significant delays or safety risks. For example, a blocked crossing may prevent emergency personnel from reaching people needing medical attention or another emergency (e.g., a fire). A blocked crossing also can pose a safety risk for other vehicle systems moving toward the crossing, and may cause significant traffic delays on multiple different routes. A need may exist for systems and methods that differ from those that are currently available to address one or more of the foregoing shortcomings.

BRIEF DESCRIPTION

In one example, a method is provided that may include determining a location of a locating device disposed onboard a vehicle system, identifying a size of the vehicle system, calculating a duration that the vehicle system has been blocking or will be blocking an intersection between at least two intersecting routes based at least in part on the location of the locating device and on the size of the multi-vehicle system, and implementing one or more responsive actions to clear the intersection responsive to the calculation of the duration.

In another example, a vehicle control system is provided and may include a controller that can identify a size of a multi-vehicle system and to calculate a duration that the multi-vehicle system has been blocking or will block an intersection between routes based on both of a location of a locating device disposed on a vehicle within the multi-vehicle system and on the size of the multi-vehicle system. The controller can implement one or more responsive actions to clear the intersection or to maintain the intersection as clear during the duration.

In another example, a method is provided that can include forecasting a stop location where a locating device will be located once a multi-vehicle system stops moving based at least in part on a moving speed of the multi-vehicle system and a braking force exerted by the multi-vehicle system, determining whether the multi-vehicle system will block an intersection between intersecting routes based at least in part on the stop location that is forecasted, and a size of the multi-vehicle system, and preventing the multi-vehicle system from stopping or allowing the multi-vehicle system to continue moving until the multi-vehicle system does not block or will no longer block the intersection responsive to determining that the multi-vehicle system will block the intersection based on the stop location that is forecasted and the size of the multi-vehicle system.

BRIEF DESCRIPTION OF THE DRAWINGS

The present inventive subject matter may be understood from reading the following description of non-limiting embodiments, with reference to the attached drawings, wherein below.

DETAILED DESCRIPTION

Figure 1:
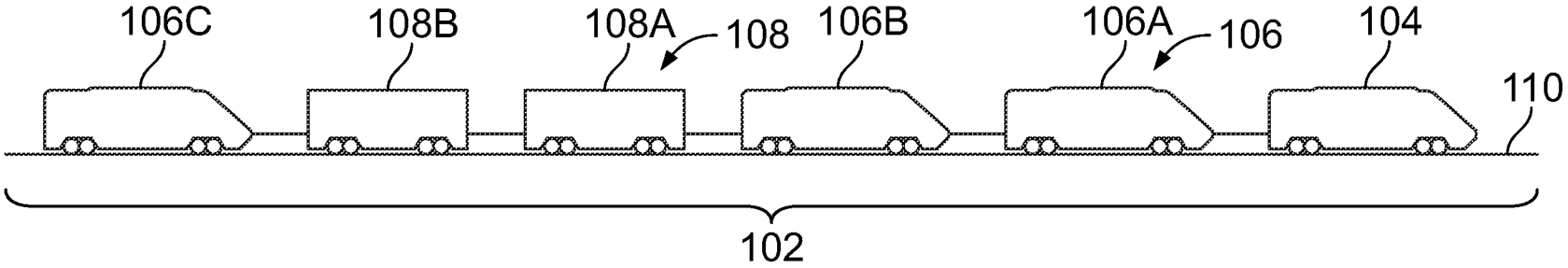
FIG. 1 illustrates a vehicle system in accordance with an embodiment.

One or more embodiments of the inventive subject matter described herein provide systems and methods for improved control of a vehicle system along a route. In various embodiments, a vehicle control system (onboard or off-board a vehicle system) can control movement of the vehicle system on a route relative to another vehicle system ahead along the same route that is moving in the same direction and/or can interact with a signaling device at the crossing location (which may drop gates, for example, to block the crossing even if the incoming vehicle system has yet to arrive).

In one embodiment, the vehicle control system of a trailing vehicle system may pace itself (i.e., the trailing vehicle system). The pacing may be based at least in part on an acceleration capability of the leading vehicle system such that the trailing vehicle system does not travel within a designated range of the leading vehicle system ahead. This may require the trailing vehicle system to stop or at least slow to increase the distance between the vehicle systems. At least one technical effect of such optimized pacing can be an increased overall throughput and efficiency along a network of routes as the trailing vehicle system is able to travel at a trailing distance behind the leading vehicle system that may be less than a trailing distance of the trailing vehicle system according to conventional pacing methods, such as relying on block signal aspects as described in more detail herein. Furthermore, such pacing can increase the overall throughput and efficiency by avoiding delays that occur as a result of the trailing vehicle system traveling too closely to the leading vehicle system, which can mandate that the trailing vehicle system slow to a stop or a low non-zero speed for a period of time before being allowed to accelerate up to a desired speed again. The stops and/or reduced speeds of the trailing vehicle system increase the travel time of the trailing vehicle system along the route and decrease the travel efficiency (e.g., increased fuel consumption, increased noise, and exhaust emissions, etc.).

In various other embodiments, a vehicle control system (onboard or off-board the vehicle system) can be provided that can control movement of a vehicle system on a route relative to an upcoming crossing (e.g., an intersection, crossing, merging, or the like, of multiple routes). For example, the vehicle control system may operate an audible warning automatically without operator input as the vehicle system approaches the grade crossing. The characteristics of the audible warning, such as whether or not to activate the warning, the volume of the warning, the start and end times of the warning, etc., may be controlled by the vehicle control system. A technical effect of such automatic warning can be a reduced operational load on the operator of the vehicle system and more consistent and accurate warning activations due to reduced human-involvement. Apart from the audible warning, other warnings may be provided as well as other responsive actions. These responsive actions may involve the approaching vehicle system, another and different approaching vehicle system, a vehicle system already located at a crossing, signaling equipment at the crossing, and the like. These responsive actions may include controlling a speed of a vehicle system, controlling an action of a signaling system, switching routes of a vehicle system, lowering or raising a gate, and the like.

Various other embodiments described herein provide a vehicle control system (onboard or off-board the vehicle system) that can control movement of the vehicle system on a route relative to work zones and other special areas of interest along the route. For example, the vehicle control system may automatically update a trip plan according to which the vehicle system is traveling based on a received order, such as a temporary slow order. A technical effect of such automatic adjustment of the trip plan can be improved control of the vehicle system through the special areas of interest.

Various other embodiments described herein provide a vehicle control system that is onboard or off-board the vehicle system, and can automatically display improved information to an operator of the vehicle system. For example, the vehicle control system may display (on an onboard visual display) information about a route aspect, such as an upcoming signal. The information for an upcoming signal may include a distance to the signal, a time of arrival to the signal, a status of the signal (e.g., red over green indication, red over yellow indication, or green over green indication), the aspect of the signal (e.g., approach medium, clear, etc.), a type of the signal, and a physical layout of the signal. A technical effect of such automatic display of this improved information can allow the operator to have advanced knowledge of the information prior to the vehicle system traveling within eyesight distance of the route aspect.

In another example of the inventive subject matter described herein, an onboard or off-board vehicle control system can determine whether the vehicle system is blocking or will block a crossing between two or more routes (e.g., an intersection or merge of routes), and implement one or more responsive actions. The vehicle control system can determine a location of a location determining device onboard the vehicle system, determine a size (e.g., a length) of the vehicle system (or at least a distance between the location determining device and an end of the vehicle system that is toward the crossing), examine a shape of a route on which the vehicle system is located, and can determine whether the vehicle system extends into or across the crossing (thereby blocking the crossing). The location of the crossing or intersection can be obtained from a memory (e.g., a track database, a route map, or the like), received from an operator, detected using one or more sensors, or the like. The vehicle control system can measure how long the vehicle system is or will be blocking the crossing, such as by starting a timer once the vehicle system is blocking the crossing. If the vehicle system blocks the crossing for longer than a threshold duration, then the vehicle control system can implement the responsive action(s). As another example, the vehicle control system can measure a moving speed of the vehicle system as the vehicle system approaches or is moving through a crossing, and measure a braking effort or force used to slow the vehicle system (e.g., to stop). The vehicle control system can use this information to predict where the vehicle system will stop and whether the size of the vehicle system in this stopped location will result in the vehicle system blocking the crossing. If the vehicle control system determines that the vehicle system will block the crossing, then the vehicle control system can either prevent the vehicle system from stopping at the predicted location, only permit the vehicle system to stop in a farther location that does not result in the vehicle system blocking the crossing, or implement one or more other responsive actions described herein. The responsive action(s) may include generating an alert to an operator of the vehicle system, preventing the vehicle system from stopping until the vehicle system is not blocking the crossing, sending alert signals to other vehicle systems to warn the other vehicle systems of the blocked crossing, sending alert signals to off-board control systems (e.g., positive or negative vehicle control systems, such as a positive train control (PTC) system), or the like. A suitable PTC system may be the I-ETMS system from Wabtec Corporation.

These and other embodiments are described in more detail herein with reference to the accompanying figures. FIG. 1 illustrates one example of a vehicle system 102, in accordance with an embodiment. The illustrated vehicle system includes propulsion-generating vehicles 104, 106 (e.g., vehicles 104, 106A, 106B, 106C) and non-propulsion-generating vehicles 108 (e.g., vehicles 108A, 108B) that travel together along a route 110. Although the vehicles are shown as being mechanically coupled with each other, the vehicles alternatively may not be mechanically coupled with each other. For example, at least some of the vehicles may not be mechanically coupled to each other, but are still operatively coupled to each other such that the vehicles travel together along the route via a communication link or the like. The number and arrangement of the vehicles in the vehicle system are provided as one example and are not intended as limitations on all embodiments of the subject matter described herein. For example, the vehicle system may be formed from a single vehicle. In the illustrated embodiment, the vehicle system is shown as a rail vehicle system (e.g., train) such that the propulsion-generating vehicles are locomotives and the non-propulsion-generating vehicles are rail cars. But, in other embodiments, the vehicle system may be an aircraft, a water vessel, an automobile, or an off-highway vehicle (e.g., a vehicle system that is not legally permitted and/or designed for travel on public roadways).

Optionally, groups of one or more adjacent or neighboring propulsion-generating vehicles may be referred to as a vehicle consist. For example, the vehicles 104, 106A, 106B may be referred to as a first vehicle consist of the vehicle system and the vehicle 106C referred to as a second vehicle consist of the vehicle system. The propulsion-generating vehicles may be arranged in a distributed power (DP) arrangement. For example, the propulsion-generating vehicles can include a lead vehicle that issues command messages to the other propulsion-generating vehicles, which are referred to herein as remote vehicles. The designations "lead" and "remote" are not intended to denote spatial locations of the propulsion-generating vehicles in the vehicle system, but instead are used to indicate which propulsion-generating vehicle is communicating (e.g., transmitting, broadcasting, or a combination of transmitting and broadcasting) command messages and which propulsion-generating vehicles are receiving the command messages and being remotely controlled using the command messages. For example, the lead vehicle 104 may or may not be disposed at the front end of the vehicle system (e.g., along a direction of travel of the vehicle system). Additionally, the remote vehicles need not be separated from the lead vehicle. For example, a remote vehicle may be directly coupled with the lead vehicle or may be separated from the lead vehicle by one or more other remote vehicles and/or non-propulsion-generating vehicles. In one embodiment, plural vehicles forming a vehicle system may be a swarm, a platoon, a fleet, and the like. For a platoon of vehicles that are not mechanically coupled, one aspect of the control system may part or parse the platoon into two or more subgroups, with each subgroup positioned between (but not across) plural crossings such that the entire platoon may stop and the length of platoon might block plural crossings if not parsed, but the controller upon stopping the platoon arranges subgroups so as to not block the crossings. And, the controller may reform the platoon when clear to move the entire platoon again.

Figure 2:
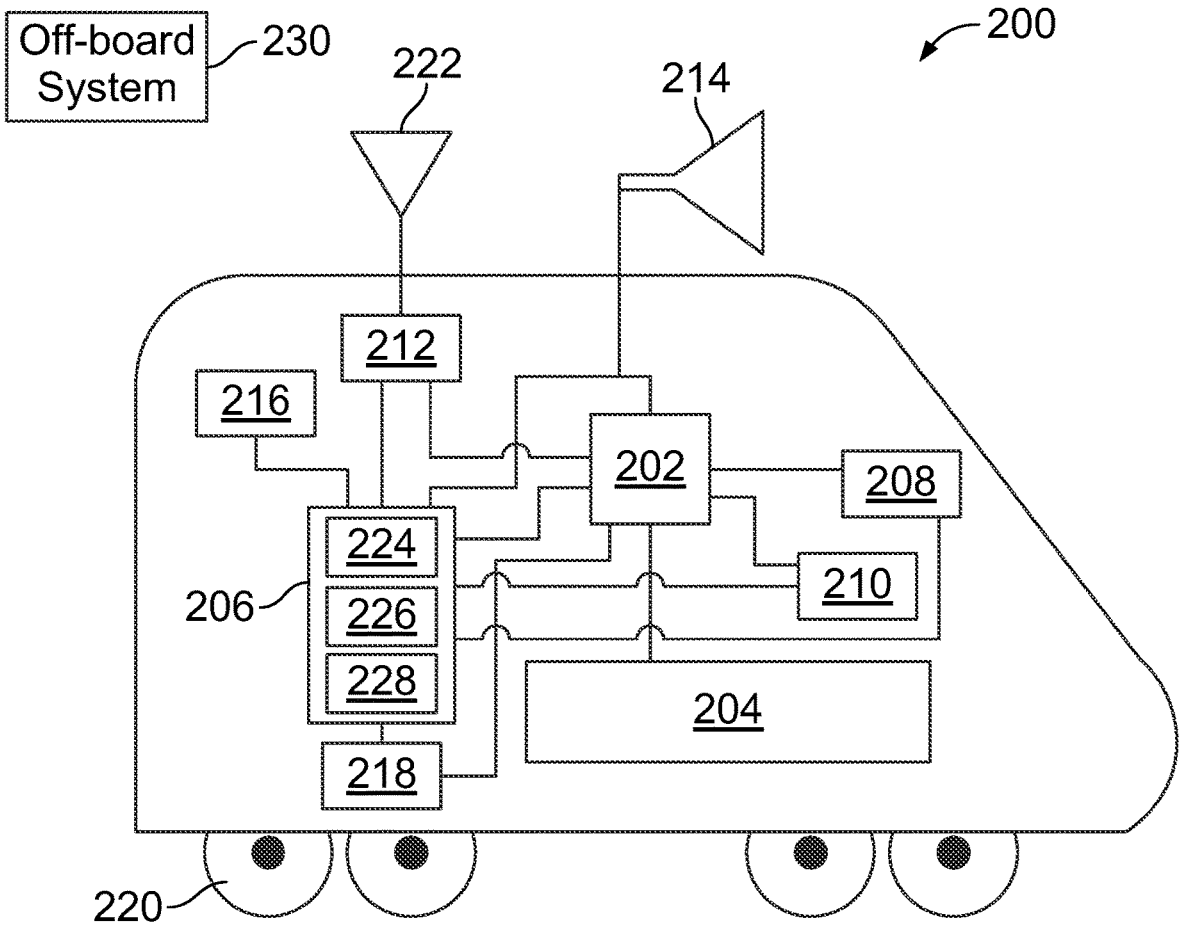
FIG. 2 is a schematic diagram of a vehicle system according to an embodiment.

FIG. 2 is a schematic diagram of a vehicle control system 200 according to an embodiment. The vehicle control system may be disposed on or in at least one vehicle of the vehicle system shown in FIG. 1. For example, the illustrated vehicle in FIG. 2 may be one of the propulsion-generating vehicles shown in FIG. 1. The vehicle control system in the illustrated embodiment may include a vehicle controller 202, a propulsion system 204, a trip planning controller 206, a display device 208, a manual input device 210, a communication circuit 212, an audible warning emitter 214, a locator or location determining device 216, and speed sensor 218. The vehicle control system may include additional components, fewer components, and/or different components than the illustrated components in other embodiments. Although all the components of the vehicle control system in the illustrated embodiment are located on the same vehicle, optionally at least some of the components are distributed among plural vehicles of the vehicle system.

The vehicle controller may control various operations of the vehicle system. The controller may include or represent one or more hardware circuits or circuitry that include and/or are connected with one or more processors, controllers, or other hardware logic-based devices. For example, the controller in an embodiment has one or more processors. Each of the processors may perform one or more, or all, of the operations described herein in connection with the controller. Optionally, different processors may perform different ones of the operations. The controller may be operatively connected with the propulsion system to control the propulsion system. The propulsion system may provide both propelling efforts and braking efforts for the vehicle system. The controller may generate control signals autonomously or based on manual input that is used to direct operations of the propulsion system, such as to control a speed of the vehicle system. The vehicle controller optionally may also control auxiliary loads of the vehicle system, such as heating, ventilation, and air-conditioning (HVAC) systems, lighting systems, and the like.

The propulsion system may include propulsion-generating components, such as motors, engines, generators, alternators, turbochargers, pumps, batteries, turbines, radiators, and/or the like, that operate to provide power generation under the control implemented by the controller. The propulsion system can provide tractive effort to power wheels of the vehicle system to move the vehicle system along the route. In another embodiment, the propulsion system may include tracks that engage the route instead of the wheels shown in FIG. 2. In a marine vessel embodiment, the propulsion system may include one or more propellers instead of the wheels to propel the vehicle system through the water. The propulsion system also may include brakes and affiliated components that are used to slow the vehicle system.

The speed sensor can monitor a speed of the vehicle system along the route. The speed sensor may monitor the speed by measuring the movement of one or more components, such as the rotational speed of one of the wheels that engage the route, the rotational speed of a drive shaft (not shown), or the like. Optionally, the speed sensor may include or may represent a location determining device or a locator device that can identify one or more locations of the sensor and/or a moving speed of the sensor. For example, the speed sensor may include or may be embodied in a global navigation satellite system (GNSS) receiver, such as a global positioning system (GPS) receiver. The speed sensor can be communicatively connected to the vehicle controller and/or the trip planning controller to communicate speed measurement signals for analysis. Although only the speed sensor is shown in FIG. 2, the vehicle system may include additional sensors (not shown), such as additional speed sensors, pressure sensors, temperature sensors, position sensors, gas and fuel sensors, acceleration sensors, and/or the like. The sensors can acquire operating parameters of various components of the vehicle system and communicate data measurement signals of the operating parameters to the vehicle controller and/or the trip planning controller for analysis.

The display device can be viewable by an operator of the vehicle system, such as a conductor or engineer. The display device may include a display screen, which may be a liquid crystal display (LCD), a light emitting diode (LED) display, an organic light emitting diode (OLED) display, a plasma display, a cathode ray tube (CRT) display, and/or the like. The display device can be communicatively connected to the vehicle controller and/or the trip planning controller. For example, the vehicle controller and/or the trip planning controller can present information to the operator via the display device, such as status information, operating parameters, a map of the surrounding environment and/or upcoming segments of the route, notifications regarding speed limits, work zones, and/or slow orders, and the like.

The manual input device may obtain manually input information from the operator of the vehicle system, and to convey the input information to the vehicle controller and/or the trip planning controller. The manually input information may be an operator-provided selection, such as a selection to limit the throttle settings of the vehicle system along a segment of the route due to a received slow order, for example. The operator-provided selection may also include a selection to activate the audible warning emitter, to control the communication circuit to communicate a message remotely to another vehicle, to a dispatch location, or the like, or to actuate the brakes to slow and/or stop the vehicle system. The manual input device may be a keyboard, a touchscreen, an electronic mouse, a microphone, a wearable device, or the like. Optionally, the manual input device may be housed with the display device in the same case or housing. For example, the input device may interact with a graphical user interface (GUI) generated by the vehicle controller and/or the trip planning controller and shown on the display device.

The communication circuit can be operably connected to the vehicle controller and/or the trip planning controller. The communication circuit may represent hardware and/or software that is used to communicate with other devices and/or systems, such as remote vehicles or dispatch stations. The communication circuit may include a transceiver (or discrete transmitter and receiver components), an antenna, and associated circuitry for wireless bi-directional communication of various types of messages, such as linking messages, command messages, reply messages, status messages, and/or the like. The communication circuit may transmit messages to specific designated receivers and/or to broadcast messages indiscriminately. Optionally, the communication circuit also includes circuitry for communicating messages over a wired connection, such as an electric multiple unit (eMU) line (not shown) between vehicles of a vehicle system, a catenary line or conductive rail of a track, or the like.

The locator device can determine a location of the vehicle system along the route. The locator device may include a global navigation satellite system (GNSS) receiver, such as a global position system (GPS) receiver or a system of sensors that determine a location of the locator device. Examples of such other systems include, but are not limited to, wayside devices, such as radio frequency automatic equipment identification (RF AEI) tags and/or video-based determinations. Another system may use a tachometer and/or speedometer aboard a propulsion-generating vehicle and distance calculations from a reference point to calculate a current location of the vehicle system. The locator device may be used to determine the proximity of the vehicle system along the route from one or more crossings in the route, from one or more other vehicles on the route, from a work zone or another speed-restricted zone, from a quiet zone, or the like.

The audible warning emitter can provide an audible warning sound to alert people and animals of the approaching vehicle system. The audible warning emitter may be a horn, a speaker, a bell, a whistle, or the like. The audible warning emitter may be automatically controlled by the vehicle controller and/or the trip planning controller. The emitter may be controlled manually by the operator using the manual input device. The manual control of the emitter may override the automatic control of the emitter. For example, the operator can activate the emitter 214 while the emitter is being automatically controlled by the vehicle controller and/or the trip planning controller.

The trip planning controller of the vehicle system may receive, generate, and/or implement a trip plan that controls movements of the vehicle system along the route to improve one or more operating conditions while abiding by various prescribed constraints. The trip planning controller includes or represents hardware circuitry that includes and/or is connected with one or more processors 224, such as a computer processor or other logic-based device that performs operations based on one or more sets of instructions (e.g., software). One or more of the processor(s) of the trip planning controller may be the same as or different from the processor(s) of the vehicle controller. Similar to the vehicle controller, the processors of the trip planning controller (where there are multiple processors) can each perform all operations of the trip planning controller, different ones of the processors may perform different operations, and/or two or more of the processors may perform one or more of the same operations. The instructions on which the trip planning controller operates may be stored on a tangible and non-transitory (e.g., not a transient signal) computer readable storage medium, such as a memory 226. The memory may include one or more computer hard drives, flash drives, RAM, ROM, EEPROM, and the like. Alternatively, one or more of the sets of instructions that direct operations of the trip planning controller may be hard-wired into the logic of the trip planning controller, such as by being hard-wired logic formed in the hardware of the trip planning controller.

The trip planning controller may receive a schedule from an off-board system 230, such as a scheduling system, a dispatch system, a positive vehicle control system, a negative vehicle control system, or the like. As a scheduling system and/or dispatch system, the off-board system may generate and/or send travel schedules to the vehicle system (s). As a positive or negative vehicle control system, the off-board control system may receive signals from the vehicle systems to monitor movements of the vehicle systems and can send signals to the vehicle systems that dictate where and when the vehicle systems are permitted to enter into different segments of routes. For example, a positive vehicle control system may send signals to the vehicle systems to indicate how fast the vehicle systems can move in different route segments, whether vehicle systems can enter a route segment, etc. Absent receiving such a signal, the vehicle controller onboard a vehicle system may not allow an operator or other system to control the vehicle system to travel at excess speeds and/or to enter a route segment. Once such a signal is received, the vehicle controller can allow the vehicle system to be controlled to travel at excess speeds and/or to enter the route segment. One example of such a positive vehicle control system is a positive train control (PTC) system. A negative vehicle control system may send signals to the vehicle systems to indicate how fast the vehicle systems can move in different route segments, whether vehicle systems can enter a route segment, etc. Absent receiving such a signal, the vehicle controller onboard a vehicle system may allow an operator or other system to control the vehicle system to travel at excess speeds and/or to enter a route segment. Once such a signal is received, the vehicle controller can prevent the vehicle system from being controlled to travel at excess speeds and/or to enter the route segment.

The trip planning controller may be operatively coupled with, for example, the communication circuit to receive an initial and/or modified schedule from the off-board system. In an embodiment, the schedules can be conveyed to the trip planning controller, and may be stored in the memory. Alternatively, the schedule may be stored in the memory of the trip planning controller via a hard-wired connection, such as before the vehicle system starts on a trip along the route. The schedule may include information about the trip, such as the route to use, the departing and destination locations, the desired total time of travel, the desired arrival time at the destination location and optionally at various checkpoint locations along the route, the location and time of any meet and pass events along the route, and the like. Optionally, movement authorities may be communicated as or in signal that indicate where and when the vehicle systems are permitted to move, as described above.

In an embodiment, the trip planning controller can generate a trip plan based on the schedule and/or movement authorities. The trip plan may include operational settings (e.g., throttle settings, brake settings, designated speeds, or the like) of the vehicle system for various segments of the route during a scheduled trip or mission of the vehicle system to the scheduled destination location. The trip plan may be generated to reduce the amount of fuel that is consumed by the vehicle system, the amount of emissions generated by the vehicle system, the amount of audible noise generated by the vehicle system, etc. during travel to the destination location (relative to travel by the vehicle system to the destination location when not abiding by the trip plan). The trip plan may designate or dictate different operational settings at different locations, times, distances, etc. Controlling the vehicle system according to the trip plan may result in the vehicle system consuming less fuel, generating fewer emissions, creating less noise, etc., to reach a destination location than if the same vehicle system traveled along the same routes to arrive at the same destination location at the same time as the trip plan (or within a relatively small time buffer, such as one to three or five percent of the total trip time, or another relatively small percentage), but traveling at speed limits (e.g., track speed) of the routes.

To generate the trip plan for the vehicle system, the trip planning controller can refer to a trip profile that includes information related to the vehicle system, information related to a route over which the vehicle system travels to arrive at the scheduled destination, and/or other information related to travel of the vehicle system to the scheduled destination location at the scheduled arrival time. The information related to the vehicle system may include information regarding the fuel efficiency of the vehicle system (e.g., how much fuel is consumed by the vehicle system to traverse different sections of a route), the tractive power (e.g., horsepower) of the vehicle system, the weight or mass of the vehicle system and/or cargo, the length and/or other size of the vehicle system, the location of powered units in the vehicle system, and/or other information. The information related to the route to be traversed by the vehicle system can include the shape (e.g., curvature), incline, decline, and the like, of various sections of the route, the existence and/or location of known slow orders or damaged sections of the route, and the like. Other information can include information that impacts the fuel efficiency of the vehicle system, such as atmospheric pressure, temperature, precipitation, and the like. The trip profile may be stored in the memory of the trip planning controller.

The trip plan is formulated by the trip planning controller based on the trip profile. For example, if the trip profile requires the vehicle system to traverse a steep incline and the trip profile indicates that the vehicle system is carrying significantly heavy cargo, then the one or more processors of the trip planning controller may generate a trip plan that includes or dictates increased tractive efforts for that segment of the trip to be provided by the propulsion system of the vehicle system. Conversely, if the vehicle system is carrying a smaller cargo load and/or is to travel down a decline in the route based on the trip profile, then the one or more processors of the trip planning controller may form a trip plan that includes or dictates decreased tractive efforts by the propulsion system for that segment of the trip. In an embodiment, the trip planning controller includes a software application or system such as the Trip Optimizer™ system. The trip planning controller may directly control the propulsion system, may indirectly control the propulsion system by providing control commands to the vehicle controller, and/or may provide prompts to an operator for guided manual control of the propulsion system.

The trip planning controller further may include a clock 228 that can be synchronized to a common timing scheme. In some embodiments, the clock may be operatively connected to a GNSS receiver of the locator device to provide an absolute time based on a GNSS signal. The clock can provide the trip planning controller with information about the time of day. Optionally, the clock can be used to measure how long the vehicle system is blocking a crossing, as described herein.

In the illustrated embodiment, the one or more processors, the memory, and the clock are contained within the trip planning controller. In one embodiment, the processor(s), the memory, and the clock are housed within a common hardware housing or case. In an alternative embodiment, however, these components are not all housed within a common housing, such that at least one of the processor(s), the memory, or the clock is disposed in a separate housing or case from the other component(s) of the trip planning controller, or is otherwise separate from the trip planning controller.

Figure 3:
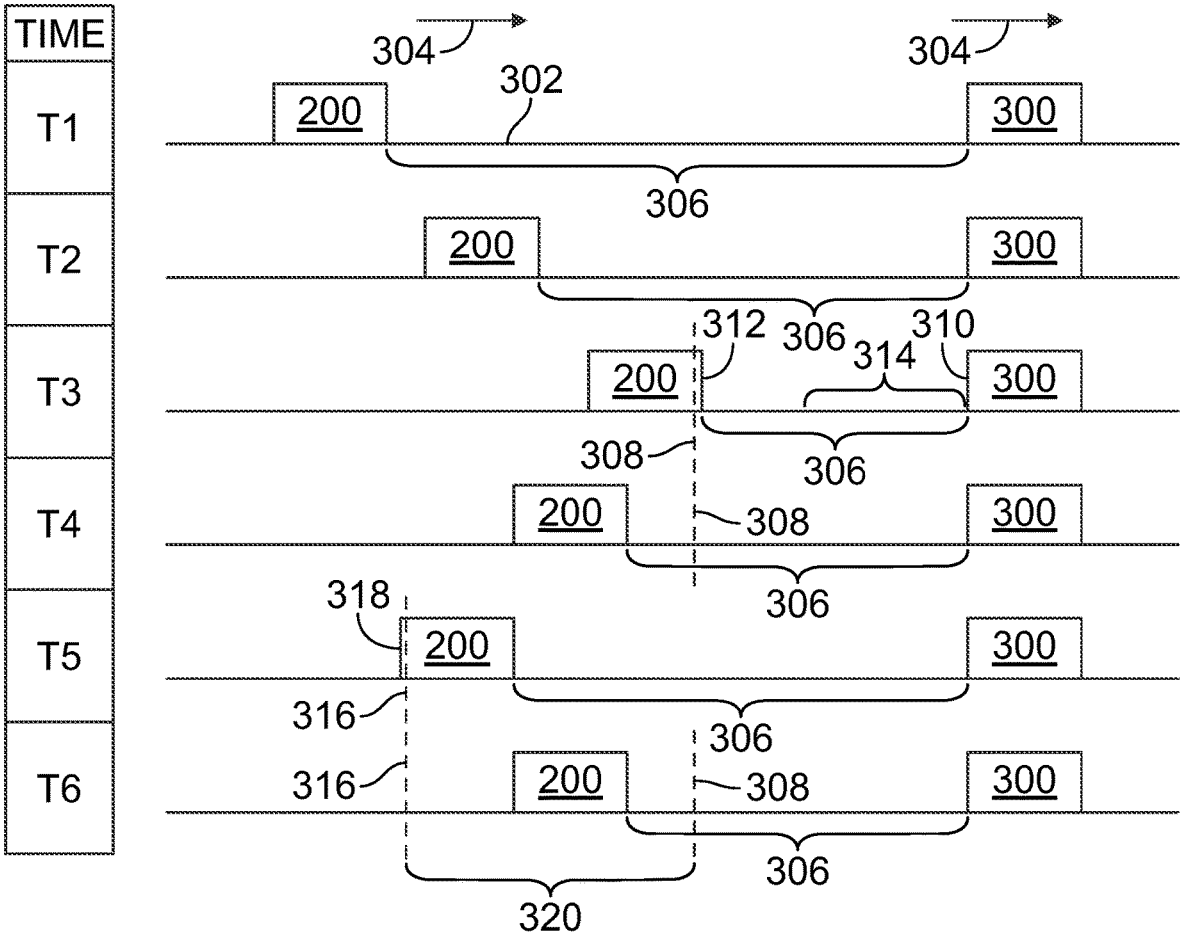
FIG. 3 is a schematic diagram showing a trailing vehicle system and a leading vehicle system ahead of the trailing vehicle system along a route at different times during a trip of the trailing vehicle system.
Figure 4:
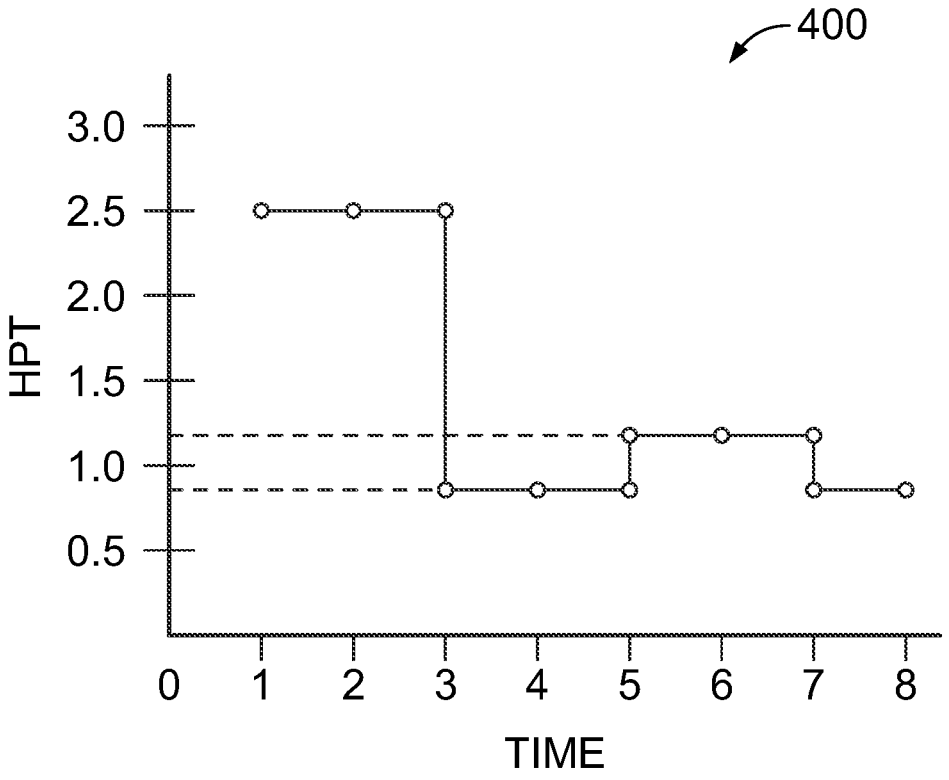
FIG. 4 is a graph of horsepower per tonnage (HPT) of the vehicle system over time during the trip of the vehicle system shown in FIG. 3.

FIG. 3 is a schematic diagram showing the vehicle system and a leading vehicle system 300 ahead of the vehicle system along a route 302 at different times during a trip of the trailing vehicle system 200. FIG. 4 is a graph 400 of horsepower per tonnage (referred to herein as "HPT") of the trailing vehicle system over time during the trip of the trailing vehicle system shown in FIG. 3. The information presented in FIGS. 3 and 4 is merely for illustration and is not intended to be limiting.

The HPT of the trailing vehicle system is a performance indicator of the trailing vehicle system. The HPT is a power-to-weight ratio, or power output per weight, that indicates an acceleration capability of the trailing vehicle system. The HPT is calculated as the total available (e.g., maximum achievable) power output of a vehicle system divided by the weight or tonnage of the vehicle system. The total power output of the vehicle system is determined as the sum of the maximum available or achievable horsepower provided by the propulsion system (such as the propulsion system) of each propulsion-generating vehicle in the vehicle system. For example, a vehicle system having two propulsion-generating vehicles that each can provide 6,000 horsepower (e.g., 4500 kW), as a maximum achievable power output, has a total vehicle system horsepower of 12,000. The weight or tonnage of the vehicle system is the total weight of the vehicle system along the route, which is the sum of the weight of each of the vehicles in the vehicle system including weight attributable to cargo and/or passengers. For example, a vehicle system that includes two propulsion generating vehicles that each weigh 250 tons and fifty-five non-propulsion generating vehicles that each weigh 100 tons would have an HPT of 2.0 (e.g., calculated as 12,000/(2×250)+(55×100))=2.0 HP/T). Since the HPT is determined as a function of both power and weight, a first vehicle system that has twice the horsepower and twice the weight as a second vehicle system would have the same HPT as the second vehicle system. Instead of horsepower over tonnage, the power-to-weight ratio can be represented as horsepower over pounds, kilowatts over kilograms, or the like.

A higher HPT indicates a greater acceleration capability and/or speed than a lower HPT. For example, a first vehicle system with a higher HPT than a second vehicle system would be able to traverse up a hill faster than the second vehicle system because the first vehicle system is able to generate a greater acceleration up the hill. The HPT can also affect the total travel time for a given trip. For example, the first vehicle system having the greater HPT would be able to traverse a given route faster than the second vehicle system, resulting in a greater average speed and a lower total travel time than the second vehicle system. Therefore, a trailing vehicle system that has a greater HPT than a leading vehicle system traveling along the same route ahead of the trailing vehicle system can travel faster than the leading vehicle, at least along flat and inclined segments of the route. The trailing vehicle system may travel at a greater actual or effective power-to-weight ratio than the leading vehicle system, which causes the trailing vehicle to reduce the gap or trailing distance that separates the two vehicle systems.

Assuming there is no meet and pass event scheduled, if the trailing vehicle system gets too close to the leading vehicle system ahead, as a safety precaution the trailing vehicle system may be required by regulation to slow to a stop or a significantly low speed (e.g., 2 miles per hour (mph), 5 mph, 10 mph, or the like) to increase the gap between the two vehicle systems. Forcing the trailing vehicle system to come to a stop or to slow to a significantly low speed is inefficient as it lowers throughput along the route, reduces fuel economy of the trailing vehicle system, increases the length of time of the trip of the trailing vehicle system, and/or the like. Prior to being forced to slow and/or stop, the trailing vehicle system may have been traveling over the route according to a designated trip plan that can reduce energy consumption, emissions, noise, equipment wear and tear, travel time, and/or the like. The trip plan may not have accounted for the leading vehicle system traveling slower along the route. The requirement for the trailing vehicle system to slow and/or stop due to proximity to the leading vehicle system causes the trailing vehicle system to deviate from the designated trip plan until the trailing vehicle system is allowed to return to speed.

In one or more embodiments described herein, the trip planning controller 206 (shown in FIG. 2) of the trailing vehicle system can account for vehicle systems ahead of the trailing vehicle system along the same route that have a lower HPT than the trailing vehicle system. For example, the trip planning controller 206 is able to pace the trailing vehicle system based on the leading vehicle system ahead of the trailing vehicle system. The adopted pace of the trailing vehicle system is likely slower overall than the speed profile at which the trailing vehicle system would traverse the route without a leading vehicle system on the route, but the pace of the trailing vehicle system is designed to avoid the need to stop and/or slow to a significantly low speed. Thus, the total travel time, fuel consumption, and/or emissions would likely be lower by pacing than if the trailing vehicle system travels according to a designated trip plan that does not account for the leading vehicle and results in the trailing vehicle system being forced to stop and/or slow considerably at least once during the trip.

FIG. 3 shows the trailing vehicle system and the leading vehicle system along the route 302 at six different times (e.g., T1, T2, T3, T4, T5, T6) during a trip of the trailing vehicle system. Both vehicle systems 200, 300 travel in the same direction 304 along the route 302. FIG. 3 shows how the relative distance between the leading and trailing vehicle systems changes over time. Thus, although the leading vehicle system is shown in the same location at each time, the leading vehicle system may be moving and therefore the location of the leading vehicle system relative to the route may be different at each time. The distance between the leading vehicle system and the trailing vehicle system is referred to as the trailing distance or gap 306. The different times may represent various increments of time, such as minutes, hours, or tens of hours. For example, the time that elapses between times T1 and T2 may be one hour, two hours, five hours, or the like. The time increments may be constant between times T1 and T6, but optionally are not constant.

In the illustrated embodiment, the leading vehicle system has an HPT of 1.0 and the trailing vehicle system has an HPT of 2.5. Therefore, the power-to-weight ratio or power output per weight of the trailing vehicle system is greater than the power-to-weight ratio of the leading vehicle system. These values represent the capabilities of these vehicle systems. For example, the HPT of 2.5 corresponds to an upper power output limit (e.g., a maximum achievable power output per weight) of the trailing vehicle system. The trailing vehicle system may not be able to exert more horsepower than the 2.5 times the weight of the trailing vehicle system. Likewise, the leading vehicle system may be unable to exceed the 1.0 power-to-weight ratio.

Each of the vehicle systems may travel along different segments of the route at different power outputs depending on route characteristics and other factors, such that the vehicle systems may often provide a current power output that is less than the respective upper power output limit. For example, the trailing vehicle system may have an upper power output limit of 12,000 horsepower but generates less than 12,000 horsepower along various segments of the route according to the trip plan. The trip plan can designate throttle and brake settings of the trailing vehicle system during the trip based on time or location along the route. The throttle settings may be notch settings. In one embodiment, the throttle settings include eight notch settings, where Notch 1 is the low throttle setting and Notch 8 is the top throttle setting. Notch 8 corresponds to the upper power output limit, which is 12,000 horsepower in one embodiment. Thus, when the trailing vehicle system operates at Notch 8, the trailing vehicle system may provide a power output at the upper power output limit (which is associated with the HPT of the trailing vehicle system).

During a trip, the trip plan may designate the trailing vehicle system to travel at Notch 5 along a first segment of the route, at Notch 7 along a second segment of the route, and at Notch 8 along a third segment of the route. As such, the trailing vehicle system can be controlled to generate a power output that varies over time and/or distance along the route. The generated power output may be equal to the upper power output limit at some locations (e.g., along the third segment of the route) and lower than the upper power output limit at other locations (e.g., along the first and second segments).

In the pacing embodiment described in FIGS. 3 and 4, the trailing vehicle system can move automatically according to the leading vehicle system. Thus, the trailing vehicle system may alter the movements of the trailing vehicle system along the route based on the movement and characteristics of the leading vehicle system, but the leading vehicle system may not move based on the trailing vehicle system. For example, the trailing vehicle system can determine the HPT of the leading vehicle system. The trailing vehicle system may determine the HPT of the leading vehicle system based on a received message. The communication circuit may receive a wireless message from the leading vehicle system, from a dispatch location, or from another remote source that indicates that the HPT of the leading vehicle system is 1.0. In an alternative embodiment, the identification and HPT of the leading vehicle system may be stored in the memory of the trailing vehicle system prior to the trip. The trailing vehicle system also may receive status messages that indicate the location of the leading vehicle system. For example, the leading vehicle system may transmit the current location of the leading vehicle system to the trailing vehicle system periodically (e.g., every 10 seconds, every 30 seconds, every minute, every 5 minutes, etc.) or responsive to receiving a request from the trailing vehicle system. The leading vehicle system may transmit the updated location of the leading vehicle system wirelessly or conductively along a catenary wire or a conductive track of the route. Optionally, a dispatch or another off-board source may communicate the updated location of the leading vehicle system to the trailing vehicle system. In another example, the trailing vehicle system may dispatch an aerial device, such as a drone, that can remotely fly from the trailing vehicle system to the leading vehicle system to monitor the location(s) of the leading vehicle system.

FIG. 4 shows the effective HPT of the trailing vehicle system over time. The "effective" HPT, as used herein, can be a power-to-weight ratio that represents a "permitted" power output per weight limit for the trailing vehicle system. The permitted power output per weight limit can be a selected or designated limit that may be equal to or less than the maximum achievable power output per weight (or other upper limit) that may be based on the capabilities of the trailing vehicle system. Thus, although the trailing vehicle system may be capable of providing 12,000 horsepower at the top throttle setting, the permitted power output per weight limit may restrict the trailing vehicle system to generating only power outputs that are lower than 12,000 horsepower, such as by limiting the throttle settings to avoid at least the top throttle setting. When the permitted power output per weight limit is less than the maximum achievable power output per weight, the acceleration and/or speed of the trailing vehicle system can be restricted or limited as the trailing vehicle system travels along the route. The HPT values plotted in the graph 400 can represent upper limits (e.g., constraints) and not actual power outputs provided by the trailing vehicle system.

As shown in the graph 400, the trailing vehicle system can travel along the route according to an effective HPT of 2.5 between times T1 and T2. Thus, the trailing vehicle system can generate power outputs up to, but not exceeding, 2.5 times the weight of the trailing vehicle system. Although the effective HPT based on the permitted power output per weight limit is 2.5 between times T1 and T2, the actual power output generated during at least a portion of the period may be less than the permitted power output per weight limit. As shown in FIG. 3, the trailing distance between the vehicle systems decreases from time T1 to time T2. The reduced trailing distance is attributable to the trailing vehicle system traveling faster than the leading vehicle system due to a greater effective HPT than the leading vehicle system, which has an HPT value of 1.0

(representing the maximum achievable power output per weight). The trailing vehicle system can determine the trailing distance based on the known location of the trailing vehicle system (e.g., using the locator device) and the location of the leading vehicle system as received in a message from the leading vehicle system, a dispatch location, an aerial device, or the like.

Between times T2 and T3, the trailing vehicle system can make up ground on the leading vehicle system. At time T3, the trailing vehicle system crosses a first proximity threshold 308 relative to the leading vehicle system. The first proximity threshold can be disposed rearward from a rear end 310 of the leading vehicle system. The first proximity threshold can be located at a first proximity distance from the leading vehicle system. In an embodiment, the trailing vehicle system may cross the proximity threshold upon a front end 312 of the trailing vehicle system extending beyond the proximity threshold. Alternatively, the trailing vehicle system crosses the proximity threshold upon a rear end 318 of the trailing vehicle system or a designated vehicle in the trailing vehicle system extending beyond the proximity threshold. The trailing vehicle system can determine when the front end crosses the proximity threshold when the calculated trailing distance is less than the first proximity distance between the proximity threshold and the leading vehicle system.

The first proximity distance may be a known, static parameter that is stored in the memory or received by the trailing vehicle system via the communication circuit. Alternatively, the location of the proximity threshold relative to the leading vehicle system may be adjusted based on the speed of the leading vehicle system and/or the speed of the trailing vehicle system. For example, the proximity threshold may be located farther from the leading vehicle system as the speed of the leading vehicle system and/or the trailing vehicle system increases, due to a greater stopping distance that is necessary at higher speeds.

The first proximity distance relative to the leading vehicle system may be greater than an automatic slowdown range 314 that extends rearward from the leading vehicle system. If the trailing vehicle system enters the automatic slowdown range, the trailing vehicle system may be required to immediately slow to a stop or a non-zero low speed to avoid an accident. The trailing vehicle system can cross the first proximity threshold prior to entering the automatic slowdown range. Thus, by selectively limiting the power output of the trailing vehicle system based on the HPT of the leading vehicle system upon crossing the proximity threshold, the trailing vehicle system can avoid entering the automatic slowdown range.

The first proximity distance between the first proximity threshold and the leading vehicle system optionally may be calculated as a sum of a safe braking distance, a response time distance, and a safety margin distance. The safe braking distance can represent the distance along the path of the route that the trailing vehicle system would move before stopping in response to engagement of one or more brakes of the trailing vehicle system. For example, if the trailing vehicle system were to engage air brakes, the safe braking distance can represent how far the trailing vehicle system would continue to move subsequent to engaging the brakes before stopping all movement. The response time distance can represent the distance along the path of the route that the trailing vehicle system would travel before an operator onboard the trailing vehicle system could engage the brakes in response to identifying an event that would cause application of the brakes, such as an obstacle on the route and/or damage to the route. The safety margin distance can be additional distance along the route intended for safety. Thus, if the actual response time distance before applying the brakes is greater than the anticipated response time distance, the safety margin can accommodate the extra distance that the trailing vehicle system would travel before stopping without resulting in an accident between the trailing vehicle system and the leading vehicle system. Alternatively, the location of the proximity threshold may be a function of an installed signaling system (e.g., a function of block size) or a function of other relevant locations. For example, the first proximity distance may be the distance of a single block or two blocks along the path of the route.

In response to crossing the proximity threshold, the trip planning controller can set or designate a permitted power output per weight limit for the trailing vehicle system that is less than the maximum achievable power output per weight (that is achievable based at least in part on the hardware of the trailing vehicle system). The trailing vehicle system crosses the proximity threshold when the trailing distance is less than the first proximity distance relative to the leading vehicle system. Thus, if the maximum achievable power output of the trailing vehicle system is 12,000 horsepower, the permitted power output per weight limit may restrict the trailing vehicle system to generate no more than 8,000 horsepower. The permitted power output per weight limit may be enforced or implemented by limiting the throttle settings used to control the movement of the trailing vehicle system along the route. For example, because the top throttle setting is associated with the maximum achievable power output, the permitted power output per weight limit may restrict (e.g., prevent) the use of at least the top throttle setting, and potentially multiple throttle settings at the top range of the available throttle settings.

In an embodiment, the permitted power output per weight limit is set to be no greater than the power-to-weight ratio (e.g., maximum achievable power output per weight) of the leading vehicle system. Thus, the permitted power output per weight limit of the vehicle system 200 is less than or equal to the power-to-weight ratio of the leading vehicle system. Upon setting the permitted power output per weight limit, the trip planning controller controls the movement of the trailing vehicle system according to the permitted power output per weight limit, such that the power outputs generated by the trailing vehicle system do not exceed the permitted power output per weight limit.

At time T3, the trailing vehicle system sets the permitted power output per weight limit to be less than or equal to the HPT of the leading vehicle system. Since the HPT of the leading vehicle system is 1.0, the trailing vehicle system limits the permitted power outputs to a range that does not exceed a resulting HPT of 1.0 for the trailing vehicle system. For example, throttle setting Notch 3 may generate a power output (e.g., 3840 horsepower) that provides an HPT of 0.8 and throttle setting Notch 4 may generate a power output (e.g., 5760 horsepower) that provides an HPT of 1.2. Therefore, since setting Notch 4 as the upper permitted limit would exceed the power-to-weight ratio (e.g., 1.0) of the leading vehicle system, the Notch 3 throttle setting may be the highest throttle setting that is less than the power-to-weight ratio of the leading vehicle system. As a result, the trip planning controller can set a permitted power output limit to 3840 horsepower and/or Notch 3. As the trailing vehicle system continues to move along the route, the trip planning controller can limit the usable throttle settings to Notch 1, Notch 2, and Notch 3 for controlling the leading vehicle system. As shown in FIG. 4, the effective HPT at time T3 drops from 2.5 to 0.8, based on the adjustment to the permitted power output per weight limit.

From times T3 to T5, as shown in FIGS. 3 and 4, the trailing vehicle system travels along the route with an effective HPT of 0.8. Since the leading vehicle system travels at an HPT of 1.0 that is greater than the current HPT of the trailing vehicle system, the leading vehicle system may travel at an average speed from times T3 to T5 that is greater than the average speed of the trailing vehicle system, and the trailing distance may gradually increase.

Optionally, the trip planning controller of the trailing vehicle system can demarcate a second proximity threshold relative to the leading vehicle system. The second proximity threshold can be located a second proximity distance from the leading vehicle system. The second proximity distance is greater than the first proximity distance between the leading vehicle system and the first proximity threshold. The first proximity threshold can be referred to as a near threshold 308, and the second proximity threshold can be referred to as a far threshold 316. In an embodiment, as the trailing vehicle system travels along the route with the upper permitted power output limit associated with an HPT of 0.8 and the trailing distance relative to the leading vehicle system increases, eventually the trailing vehicle system may cross the far threshold such that a portion of the trailing vehicle system is farther from the leading vehicle system than the far threshold. Although FIG. 3 depicts a rear end 318 of the trailing vehicle system crossing the far threshold, in an alternative embodiment the far threshold may be effectively crossed upon the front end or another portion of the trailing vehicle system extending beyond the far threshold.

In response to the trailing vehicle system crossing the far threshold, the trip planning controller of the trailing vehicle system can increase the permitted power output per weight limit of the trailing vehicle system such that the effective HPT is greater than the HPT of the leading vehicle system. For example, the trip planning controller may increase the top permitted throttle setting to Notch 4, which is associated with an HPT of 1.2. Optionally, the top permitted throttle setting may be increased even higher, such as to Notch 5, Notch 6, Notch 7, or Notch 8. Thus, in one embodiment the trip planning controller may increase the top permitted throttle setting such that the resulting effective HPT is slightly greater than the HPT of the leading vehicle system. But, in an alternative embodiment, the trip planning controller may increase the effective HPT of the trailing vehicle system to the attainable HPT of 2.5. Still, upon the trailing vehicle system crossing the near threshold, the trip planning controller can lower the permitted power output per weight limit once again such that the effective HPT is lower than or equal to the HPT of the leading vehicle system.

As shown in FIG. 4, from times T5 to T6 the trailing vehicle system travels at a permitted power output per weight limit that corresponds to an HPT of 1.2. Since the effective HPT of the trailing vehicle system is once again greater than the HPT of the leading vehicle system (e.g., at 1.0), the trailing vehicle system may begin to reduce the trailing distance. The distance between the near threshold and the far threshold can be a pacing range 320. The pacing range can include or can be the area relative to the leading vehicle system that the trailing vehicle system is controlled to generally stay within to keep pace with the leading vehicle system. Although not shown in FIG. 3, eventually the trailing vehicle system traveling according to an HPT of 1.2 will reduce the trailing distance to a degree that the trailing vehicle system crosses the near threshold again.

As shown in FIG. 4, the trailing vehicle system crosses the near threshold at time T7, and, in response, the trip planning controller reduces the permitted power output per weight limit such that the effective HPT based on the permitted power output per weight limit may be no greater than the HPT (e.g., the maximum achievable power output per weight) of the leading vehicle system. Thus, the trailing vehicle system may set the HPT to 0.8 again, and the trailing vehicle system may travel between times T7 and T8 with a top permitted throttle setting that is associated with the HPT of 0.8 (e.g., Notch 3). Thus, the trailing vehicle system may travel within the pacing range of the leading vehicle system by adjusting the power output constraints of the leading vehicle system based on the relative location of the trailing vehicle system to the near and far proximity thresholds.

Figure 5:
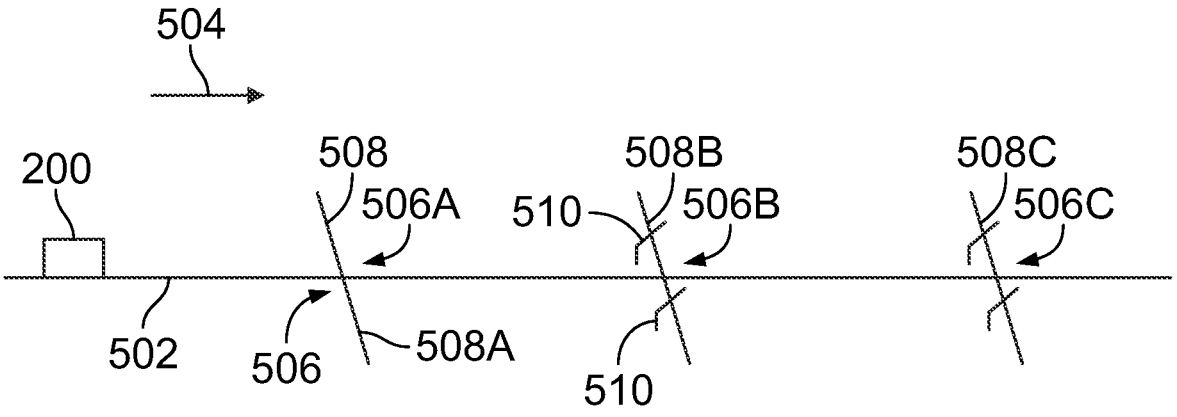
FIG. 5 is a schematic diagram of a vehicle system traveling along a route that includes multiple crossings according to an embodiment.

FIG. 5 is a schematic diagram of a vehicle system traveling along a route 502 that includes multiple crossings 506 according to an embodiment. The vehicle system may be the vehicle system shown in FIG. 2. The vehicle system can travel along the route in a direction 504 towards the crossings. Each crossing can correspond to an intersection or merger of the first route with an intersecting or merging route 508. The first route, for example, may be a railroad track over which a rail vehicle may travel. The intersecting route at each crossing may be a road or highway that is paved, leveled, or otherwise configured for automobile and/or truck travel. The crossings may be considered as grade crossings in which the intersecting route is at the grade of the first route. Optionally, the crossings may be intersections between the same type of routes for the same type of vehicle systems. For example, a crossing may be an intersection or merger of one road with another road.

The trip planning controller of the vehicle system may provide an automatic audible warning as the vehicle system approaches one or more of the crossings. Thus, the trip planning controller can control the operation of the audible warning without the need for operator input. Although operator input may not be required, the vehicle system may not override the ability of the operator to actuate the audible warning, which may be accomplished via the manual input device. Thus, the trip planning controller may actuate the audible warning unless the operator manually actuates the audible warning in the same time period.

In an embodiment, the locations of the crossings along the route can be retrieved and/or received by the trip planning controller. For example, the locations may be retrieved from a database in the memory of the trip planning controller in which the location information is stored. The crossings may be mapped to provide the geographical coordinates of each crossing. As an alternative to retrieving the location information from a database, the information may be received from a remote source, such as from a wayside device that the vehicle system passes along the route, another vehicle system, or a dispatch location. The location information may be transmitted in a message format from the remote source to the vehicle system.

In addition to the location information, additional information associated with each crossing may also be stored in the memory or received from a remote source. The additional information may include whether the corresponding crossing is private or public, whether the crossing is marked or unmarked, and whether there are any restrictions or rules associated with the crossing. A private crossing is privately owned, such as a dirt road on a farm that crosses the route. A public crossing is publicly owned, such as a public paved street or highway. Marked crossings include signs, indicator lights, crossing gates, and/or the like, to warn people and animals when a vehicle system is approaching the crossing, and unmarked crossings may not include such items. For example, private crossings may be unmarked or marked crossings. Public crossings are typically all marked crossings.

The restrictions and/or rules may include noise level restrictions based on time of day, location (e.g., work zones, quiet zones), and/or the like. For example, a specific crossing may be located in a quiet zone in which vehicles traveling along the route are instructed not to actuate an audible warning as the vehicle approaches the crossing during night hours, such as between 10 P.M. and 6 A.M. In another example, the vehicle may be allowed to actuate an audible warning as the vehicle approaches the specific crossing at a given time of day, but the noise level of the audible warning is restricted to be less than a designated threshold noise level, such as 100 decibels (dB), 80 dB, 50 dB, or the like. Optionally, the restrictions and/or rules may include speed restrictions and/or emissions restrictions through the crossings in addition to noise restrictions. Therefore, as the vehicle system travels along the route, the locations of and identifying information about each crossing may be known and stored in a database of the vehicle system. Optionally, the vehicle system may receive updated information about the crossings as the vehicle system moves along the route, such as by the communication circuit receiving status messages that update noise level restrictions for one or more of the upcoming crossings. The update information can come from a centralized source (e.g., a dispatch center) or from devices installed at or near the crossings.

As the vehicle system travels towards the crossings, the trip planning controller monitors the current location of the vehicle system relative to the crossings and the current time of day. The trip planning controller can monitor the current location of the vehicle system via the locator device and can monitor the current time of day via the clock. The trip planning controller and/or the vehicle controller can determine the proximity of the vehicle system to each of the crossings as the vehicle system moves along the route based on the stored locations of the crossings and the monitored location of the vehicle system. The controller can monitor the speed of the vehicle system via the speed sensor.

As shown in FIG. 5, the vehicle system can first approach a first crossing 506A. The intersecting route at the first crossing can be a first intersecting route 508A. The first crossing in the illustrated embodiment is a private crossing, and the route may be a private dirt, stone, or paved road. In an embodiment, the controller can use the stored database to identify the upcoming crossing as a private crossing that does not require an audible warning. For example, since the intersecting route has very little traffic, there is little risk of a person being present on the route as the vehicle system traverses through the crossing. Thus, the controller may not actuate the audible warning emitter as the vehicle system traverses the first crossing.

As the vehicle system travels between the first crossing and a second crossing 506B along the route, the controller can identify the upcoming second crossing in the database that is stored in the memory based on the location of the vehicle system relative to the stored location of the second crossing. Upon identifying the second crossing, the controller can consult the database to determine the type of crossing and whether any noise restrictions are present, and also may determine the proximity of the vehicle system to the second crossing. In the illustrated embodiment, the second crossing may be a public crossing that includes markings, such as crossing gates 510. Although such a public crossing may typically necessitate an audible warning, the second crossing is associated with a time-of-day noise restriction that prohibits the sounding of any warning between the hours of 9 P.M. and 7 A.M. each day. The controller can determine, via the clock, that the current time is 4 A.M. and so the vehicle system may travel through the second crossing within the restricted time period. Therefore, the controller can determine that the audible warning emitter will not be actuated as the vehicle system approaches and passes through the second crossing.

The vehicle system may next approach a third crossing 506C after traversing the second crossing. Based on the information stored in the database on the vehicle system and the determined current location of the vehicle system, the controller may identify the third crossing as a public, marked crossing. The third crossing may be near residential housing, for example, and there is a noise restriction associated with the third crossing that limits the noise level of audible warnings to be no greater than 100 dB. Therefore, the controller may prepare to actuate the audible emitter at a level that produces a warning no greater than 100 dB. The controller may continue to monitor the proximity of the vehicle system to the third crossing and the speed of the vehicle system as the vehicle system approaches the third crossing. The controller may determine when to actuate the emitter based on the speed and proximity to the third crossing.

For example, a regulation may direct the audible warning to consist of a sequence of two long pulses, one short pulse, and one long pulse at the end, such that the long pulse occurs as the front of the vehicle system passes through the corresponding crossing. The entire sequence may take a given time period or duration, such as 15 seconds. Therefore, based on the speed of the vehicle system and the known time period for the sequence of warning sounds, the controller can determine the distance from the third crossing at which to initiate the sequence of warning sounds. For example, if the vehicle system travels at a constant speed of 60 mph and the time period for the sequence of warning sounds is 15 sec, then the controller can determine that the sequence should be initiated when the front of the vehicle system is 0.25 miles from the third crossing (e.g., distance=speed*time). The controller may continue to monitor the location of the vehicle system relative to the third crossing, and can actuate the audible warning emitter to generate the warning sequence (at a noise level of less than 100 dB) responsive to the front of the vehicle system crossing the quarter mile proximity threshold.

One or more technical effects of the automatic warning system described above is a reduced operational load on the operator of the vehicle system and more consistent and accurate warning activations due to reduced human involvement.

In one or more embodiments, the display device of the vehicle system can automatically display information to an operator of the vehicle system regarding upcoming route aspects, such as crossings, signals, and the like. For example, as the vehicle system approaches a crossing, the controller may display on the display device a countdown in terms of distance and/or time until the vehicle system reaches the crossing. For example, the countdown may be displayed adjacent to an icon or symbol for a crossing as a successive series of distances, such as 1 mi ahead, 0.5 mi ahead, 0.25 mi ahead, and the like. The countdown is determined based on the known location of the crossing, the speed of the vehicle system, and the location of the vehicle system. The controller may also display information about the crossing, such as whether the controller will actuate the audible warning emitter for this crossing. For example, the controller may display an indicator to an operator that identifies the upcoming crossing as being associated with a quiet order that restricts audible warnings. The display device may provide a text-based signal that states, for example, "Quiet zone; Horn not activated." Thus, the operator viewing the display device can be notified that the audible warning emitter should not be actuated upon approaching the upcoming crossing.

In an embodiment, the display device of the vehicle system may also be display information about wayside signal aspects, such as crossing signals, block signals, and the like. The controller may display both proximity information, such as a countdown in terms of distance and/or time, of an upcoming signal aspect as well as additional information identifying and describing the signal aspect. For example, an upcoming signal aspect may be a block signal that provides an indicator of whether another vehicle is ahead along the route in one of the next few blocks, such as one of the next two blocks. The route may be electrically segmented to form multiple blocks arranged side-by-side along a length of the route. If a vehicle system is approaching a block in which another vehicle is currently occupying, a block signal may notify the approaching vehicle system to slow to a stop to avoid an accident. Similarly, if the vehicle system approaches a first block and another vehicle is currently occupying a second block next to and beyond the first block, the block signal may notify the approaching vehicle system to slow to a designated lower speed and/or to be prepared to stop. Some block signals may provide an "all clear" signal if the upcoming few blocks are unoccupied, a "stop" signal if the upcoming block is occupied, and an "approach" signal if the first upcoming block is unoccupied but the second upcoming block is occupied. Optionally, the "all clear" signal aspect may be represented by a green over red indication on the block signal, the "stop" signal may be represented by two red lights, and the "approach" signal may be represented by a yellow over red indication.

In an embodiment, the controller can store location information and identification information about the signal aspects in a database within the memory. The identification information may include a type of signal (e.g., crossing signal or block signal), a part number of the signal, a physical layout of the signal, and the like. For example, the controller may store a graphical image that corresponds to the actual signal device. Thus, as the vehicle system approaches the signal aspect, the controller can identify the upcoming signal and display the graphical image on the display device. Furthermore, the controller can receive a status of the signal, such as whether a given block signal is providing an "all clear" signal, an "approach" signal, or a "stop" signal aspect. The controller can receive the status of the signal via a message from a wayside device (e.g., the signaling device), a dispatch location, another vehicle, an aerial device ahead of the vehicle system, or the like. The controller may receive the status of the signal before the status is within eyesight of the operator, due to the distance or obstacles between the signal and the vehicle system. In an embodiment, upon receiving the status of the signal device, the controller can display the status on the display device as an indicator for viewing by the operator. The indicator may be presented on the graphical image of the signal device. For example, if the status is an "all clear" signal, the controller may display a green light in an appropriate location on the graphical image of the signal device. Optionally, if the status is an "approach" signal or a "stop" signal aspect, the controller may take further actions in addition to displaying the corresponding graphics on the display device. For example, the controller may also actuate an audible, visual, and/or tactile (e.g., vibrating) alert for the operator. The controller optionally may automatically slow the vehicle system or at least instruct the operator to manually slow the vehicle system. The controller also may automatically send a message to an off-board location, such as to a dispatch location or to one or more surrounding vehicles. One or more technical effects of the display system described above is to allow the operator to have advanced knowledge of the information prior to the vehicle system traveling within eyesight distance of a route aspect, such as a block signal or a crossing signal.

In an embodiment, the controller can update a generated trip plan during a trip of the vehicle system along a route based on an order received via a PTC network. The PTC network may provide location-based orders for vehicles traveling through designated locations. The orders may be based on a rule or requirement of operation for a particular route segment, such as a speed limit or the like. The orders received via the PTC network may override or interrupt a previously planned controlled activity (e.g., a control activity previously determined by the controller) and/or an operator-controlled activity. For example, upon receiving a slow order from the PTC network (e.g., from the off-board system), the vehicle system may be controlled to automatically slow to a designated speed posted in the slow order. The automatic braking may be controlled by the controller. The communication circuit may receive the PTC orders or signals. In an embodiment, information from an order received via the PTC network may be displayed on the display device to the operator of the vehicle system. The information may include the designated speed limit for a designated segment of the route. The operator may use the manual input device to confirm the slow order. The controller may generate an updated trip plan that incorporates the PTC order. For example, the controller may re-plan the segment of the trip associated with the slow order and may incorporate the designated speed limit of the slow order as a constraint in the analysis.

In another embodiment, the controller may automatically control movement of the vehicle system through a work zone (e.g., a maintenance of way (MOW) zone) based on operator-input. For example, as the vehicle system approaches a work zone in which a crew may be actively working on the route, the operator and/or the controller may receive a communication from the crew, such as from a foreman of the crew. The communication may express how the vehicle system should travel through the work zone for the safety of the crew. For example, the communication may indicate that the vehicle system is allowed to travel through the work zone at full speed, at a designated lower speed, or is required to stop before entering the work zone. In one embodiment, the operator may receive the communication, such as through a phone, a handheld transceiver, or the like, and may convey the message to the controller via the manual input device. Alternatively, the controller may receive the communication from the crew, such as via the communication circuit, and displays the information to the operator on the display device. The operator is then able to confirm and/or select a movement plan for the upcoming work zone using the manual input device. In response to receiving an operator selection, the controller can modify the trip plan to incorporate the selection. For example, in response to receiving an operator selection of traveling through the work zone at no more than 20 mph, the controller may re-plan the segment of the trip associated with the work zone and may incorporate the designated speed limit of 20 mph as a constraint in the re-planning analysis. Thus, the controller may continue to control the movement of the vehicle system as the vehicle system traverses through the work zone.

Figure 6:
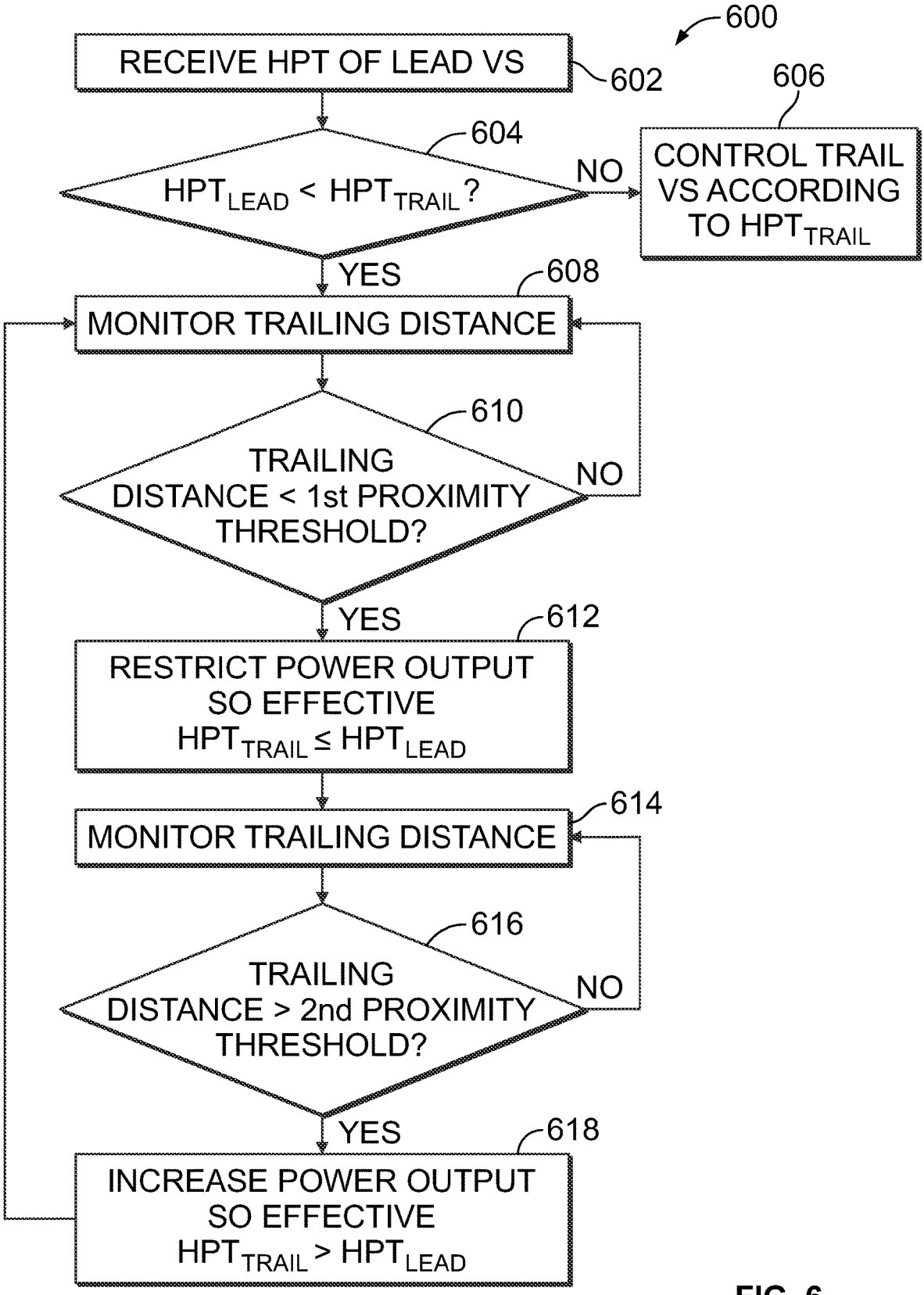
FIG. 6 is a flow chart of a method for controlling a vehicle system relative to another vehicle system ahead that is traveling along the same route in the same direction.

FIG. 6 is a flow chart of one example of a method 600 for controlling a vehicle system relative to a vehicle system ahead traveling along the same route in the same direction. The vehicle system may be the vehicle system shown in FIG. 2 and FIG. 3. The method can pace the movement of the vehicle system, referred to as a trailing vehicle system, based on the movement of a leading vehicle system ahead of the trailing vehicle system on the same route. The method can avoid the trailing vehicle system traveling too closely to the leading vehicle system, requiring the trailing vehicle system to stop and/or slow to considerably low speed for safety reasons. At step 602, the trailing vehicle system can receive a power-to-weight ratio of the leading vehicle system. The power-to-weight ratio can represent the available power output of a vehicle system (to be used for propelling the vehicle system along the route) divided by the weight or mass of the vehicle system. In an embodiment, the power-to-weight ratio may be represented as HPT, which stands for horsepower per tonnage. The HPT of the leading vehicle system may be received as a message communicated wirelessly, may be stored in a database onboard the trailing vehicle system, or the like. After the HPT of the leading vehicle system is received, the HPT of the leading vehicle system (shown in FIG. 6 as $HPT_{Lead}$) can be compared to the HPT of the trailing vehicle system (shown in FIG. 6 as $HPT_{Trail}$).

At step 604, a determination or decision may be made as to whether the HPT of the leading vehicle system is less than the HPT of the trailing vehicle system. If not, such that the HPT of the leading vehicle is equal to or greater than the HPT of the trailing vehicle, then flow of the method can proceed toward step 606, and the trailing vehicle system is controlled along the route according to the HPT of the trailing vehicle system. Therefore, the trailing vehicle system may not be controlled based on the leading vehicle system. If, on the other hand, the HPT of the leading vehicle is indeed less than the HPT of the trailing vehicle system, then flow can proceed toward step 608.

At step 608, a trailing distance between the leading vehicle system and the trailing vehicle system can be monitored. The trailing distance may be monitored using a locator device on the trailing vehicle system to determine updated location information for the trailing vehicle system and a communication circuit that receives messages regarding the updated location of the leading vehicle system. Alternatively, the trailing distance may be monitored by consulting a trip plan being implemented by the leading vehicle system. For example, the trailing vehicle system may analyze the trip plan according to which the leading vehicle system is being controlled to determine an expected location of the leading vehicle system at a respective time. The trip plan implemented by the leading vehicle system optionally may be generated by the trailing vehicle system and communicated to the leading vehicle system.

At step 610, a determination is made as to whether the trailing distance is less than a first proximity distance relative to the leading vehicle system. Thus, if the trailing vehicle system is closer to the leading vehicle system than a first proximity threshold that demarcates a distal end of the first proximity distance, then the determination is in the affirmative and flow of the method can proceed toward step 612. But, if the trailing vehicle system is not closer to the leading vehicle system than the first proximity threshold, then the determination is negative, and flow returns to step 608 for continued monitoring of the trailing distance.

At step 612, the power output of the trailing vehicle system can be restricted or limited such that an effective HPT of the trailing vehicle system is less than or equal to the HPT of the leading vehicle system. For example, the trailing vehicle system may limit the power output by restricting the throttle settings. Instead of using notch levels 1 through 8, the throttle settings may be limited such that only notch levels 1 through 5 are used. At the lower throttle settings, the power generated for propelling the vehicle system provides an effective power-to-weight ratio that is no greater than the available power-to-weight ratio of the leading vehicle system. At step 614, the trailing distance between the leading and trailing vehicle systems is monitored, like at step 608. At step 616, a determination is made whether the trailing distance is greater than a second proximity distance. The second proximity distance is measured from the leading vehicle system and extends to a second proximity threshold at a distal end of the second proximity distance. The second proximity threshold is farther from the leading vehicle system than the first proximity threshold. If the trailing distance is greater than the second proximity distance, then at least a portion of the trailing vehicle system is farther from the leading vehicle system than the second proximity threshold, and flow continues to step 618. If, on the other hand, the trailing distance is not greater than the second proximity distance, then the determination is negative and flow of the method 600 can return to step 614 for continued monitoring of the trailing distance.

At step 618, the power output of the trailing vehicle system can be increased such that the effective HPT of the trailing vehicle system is greater than the HPT of the leading vehicle system. Therefore, instead of being restricted to using throttle settings of notch levels 1-5, the effective HPT is increased by allowing the use of notch level 6, notch levels 6 and 7, or all the notch levels 6, 7, and 8. The throttle settings can be used by the trip planning controller according to a trip plan to control the movement of the trailing vehicle system along the route. After step 618, flow can return to step 608 for continued monitoring of the trailing distance.

In one or more embodiments described herein, a single source may control the movement of a plurality of vehicle systems along a route by establishing permitted power output per weight limits and enforcing the permitted power output per weight limits on the vehicle systems as the vehicle systems travel along the route. Thus, instead of (or in addition to) each vehicle system being paced based on the movement of the vehicle system in front, the movements of multiple vehicle systems on the route may be controlled according to a single permitted power output per weight limit. The permitted power output per weight limit may be set by a source that is off-board the vehicle systems. For example, the source that sets the permitted power output per weight limit may be located at a dispatch or scheduling center, a wayside device, a crew change location, a station, a rail yard, or the like. The permitted power output weight limit may be set lower than the maximum achievable power output per weight of at least one (e.g., some) of the vehicle systems, such that the acceleration and/or speed capabilities of these vehicle systems may be limited or restricted by the enforcement of the permitted power output per weight limit.

Although setting the permitted power output per weight limit may lower the speeds achieved by one or more of the individual vehicle systems along the route, the implementation of the permitted power output per weight limit can increase an overall vehicle throughput and efficiency along the route or some other system performance measure. For example, a technical effect of implementing a permitted power output per weight limit that is enforced against the vehicle systems traveling on the route is improved vehicle throughput along the route due to reduced variability in the movement of the vehicle systems. For example, it has generally been observed that vehicle throughput generally decreases with increased variation in the vehicle systems traveling on the route because such variation may cause an increase in braking events, starts and stops, meet-up and arrival delays, and the like, relative to the vehicle systems traveling with more uniform characteristics. For example, the throughput may increase when the vehicle systems travel according to the permitted power output per weight limit, even if the individual accelerations and/or speeds of at least some of the vehicle systems are reduced relative to traveling along the route without being constrained by the permitted power output per weight limit. In addition to improving network throughput along the route, the embodiments described herein may also reduce fuel consumption, reduce exhaust emissions, and/or reduce noise of the vehicle systems relative to not having an enforced permitted power output per weight limit.

It is recognized that power output per weight is related to acceleration capability. Although acceleration is related to speed, the permitted power output per weight limits described herein are separate and distinct from speed limits. For example, the route may have defined speed limits based on regulations. The permitted power output per weight limits described herein do not supersede applicable speed limits.

Figures 7, 8:
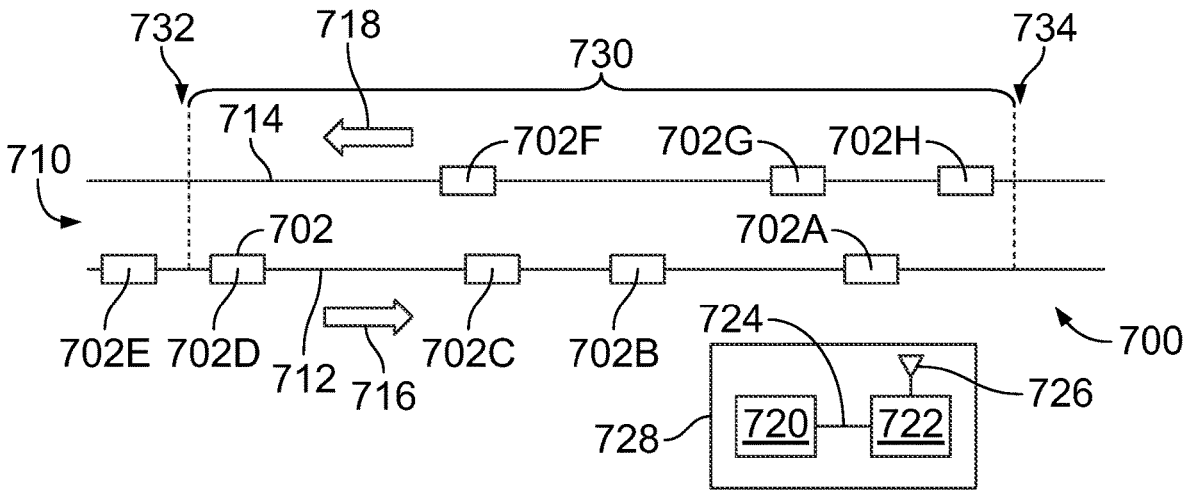
FIG. 7 a schematic diagram of a network control system that includes a plurality of vehicle systems scheduled to travel along a route according to an embodiment.
FIG. 8 is a table including a first column that lists vehicle systems scheduled to travel along the route, a second column that lists the maximum achievable power outputs per weight of the vehicle systems, and a third column that ranks the maximum achievable power outputs per weight based on magnitude.

FIG. 7 is a schematic diagram of a network control system 700 that includes a plurality of vehicle systems 702 scheduled to travel along a route 710 according to an embodiment. Each of the vehicle systems may be similar to or may represent the vehicle systems described herein. For example, although each vehicle system is depicted as a rectangle in FIG. 7, the rectangle may represent more than one vehicle operably coupled to each other to move together along the route. The route includes a first path 712 and a second path 714. The vehicle systems on the first path may move in a first direction of travel 716 (when the vehicle systems are not stationary or temporarily backing up). The vehicle systems on the second path move in a second direction of travel 718 (unless stationary or temporarily backing up). The second direction of travel may be opposite the first direction.

In an embodiment, the vehicle systems are rail vehicle systems, and the paths of the route are railroad tracks. In an alternative embodiment, the vehicle systems may be road-based trucks and the paths represent different roads or different lanes of a common road, such as a highway. In yet another embodiment, the vehicle systems may be off-road trucks, such as mining trucks, and the paths may represent off-road courses.

While only two paths are illustrated for simplicity in FIG. 7, this is not limiting, and additional paths may exist going in either direction. For example, the route may include at least three parallel paths (e.g., the two paths and at least one additional path), with some of the paths that can permit vehicle travel in the first direction and other of the paths that can permit vehicle travel in the second direction. A suitable route may be a paved highway, and the paths are lanes of the highway. The highway may have one, two, three, four, or more lanes permitting vehicle traffic in each of the directions. Furthermore, although only two directions of travel are shown in FIG. 7, the route may permit vehicular travel in more than two directions, such that some of the paths of the route may be transverse to other paths of the route (instead of parallel).

The network control system may include a network controller 720 and a communication device 722. The network controller can set a permitted power output per weight (PO/W) limit for the vehicle systems that are scheduled to travel along the route. The communication device can be connected to the network controller via a wired or wireless communication link. The network controller 720 includes one or more processors and associated hardware circuits or circuitry, such as hardware logic-based devices. The one or more processors of the network controller may operate based on programmed instructions (e.g., software) stored in a memory device accessible to the controller. The memory device may be located within the network controller or operably connected to the network controller. The communication device may be the same or similar to the communication circuit described above. For example, the communication device may include a transceiver (or a transmitter and discrete receiver), an antenna, and associated circuitry. Alternatively, the communication device may be different from the communication circuit. For example, the communication device may be a telephone, a two-way radio, a telegraph device, or the like. In another embodiment, the communication device may include or represent a printer. For example, the desired PO/W limit could be printed by the communication device on a piece of paper and carried to the vehicle by the operator, who manually enters the desired values via a user input device. In another embodiment, the communication device may be non-electronic.

The network controller can communicate with the vehicle systems via the communication device. For example, the network controller may generate network messages that are wirelessly communicated to the vehicle systems via the communication device. The network messages may designate limits and/or constraints, such as a permitted PO/W limit, for the vehicle systems to abide by as the vehicle systems travel along at least a segment of the route within a determined time period. The network messages may also include speed limits and other information, such as traffic conditions, slow orders, the location of work zones, and the like. Optionally, the network messages may also include enforcement schedules with the permitted PO/W limit. The enforcement schedules prescribe one or more enforcement periods during which the vehicle systems should enforce the permitted PO/W limit.

In the illustrated embodiment, the network controller and the communication device can be offboard all the vehicle systems and are commonly located at an offboard location 728, such as the off-board system. The offboard location may be a dispatch center or facility, a wayside device, a crew change station, a passenger or cargo station, or the like. In an alternative embodiment, the network controller and the communication device are disposed onboard one of the vehicle systems that traverses the route.

The vehicle systems may be scheduled to travel along a segment 730 of the route within a determined time period. The segment can be a length of the route that extends between a first end 732 and a second end 734. The route may extend beyond the first end and/or the second end outside of the segment. In a non-limiting example embodiment, the segment may be a subdivision or block that has a predefined location. For example, the segment may be a specific block of a series of blocks that define the route. The ends of the segment may be based on the locations of stations, such as crew change stations or passenger stations. In a non-limiting example, the segment extends from a first crew change station at the first end to a second crew change station at the second end. The length of the segment may be on the order of miles (kilometers). For example, the segment may have a length that is between 50 miles (80 km) and 300 miles (482 km), which may represent the distance traveled during a crew shift.

Optionally, the network controller may analyze the planned movement of additional vehicle systems besides the vehicle systems scheduled to travel along the segment of the route, such as vehicle systems scheduled to travel along routes nearby the illustrated route during the determined time period. For example, the network controller may analyze the planned movement of vehicle systems schedules to travel along a designated geographic area of a network of plural routes during the determined time period. The designated geographic area includes the segment shown in FIG. 7 and additional segments of the same route and/or different routes. One or more of the routes may intersect within the designated geographic area. The permitted PO/W limit may be enforced against vehicle systems scheduled to travel within the designated geographic area, even along different routes within the geographic area.

The determined time period may be a default duration of time or an amount of time that is selected by a human operator. In a non-limiting example, the determined time period may be a particular day (e.g., Wednesdays). Thus, the relevant vehicle systems may be the vehicle systems scheduled to travel along the segment of the route at any time throughout the length of a specific day. In other non-limiting examples, the determined time period may be a half day (e.g., daytime on Wednesdays) or other portion of a day, or alternatively may refer to length of time that represents multiple days, such as a week.

FIG. 7 shows eight vehicle systems that are scheduled to travel along the segment of the route within the determined time period. The vehicle systems can be scheduled according to the respective schedules of the vehicle system received from the off-board scheduling system. All or at least some of the vehicle systems can be scheduled to travel between different starting locations and ending locations. Thus, although the vehicle systems shown in FIG. 7 travel along the same stretch of the route, the vehicle systems may be different types of vehicle systems having different propulsion capabilities (e.g., power-to-weight ratios) that travel from different starting locations and/or to different destinations for different purposes (e.g., freight transport, passenger transport, work vehicles, etc.), similar to the vehicles that traverse a highway during a period of time.

Five of the vehicle systems, including a first vehicle system 702A, a second vehicle system 702B, a third vehicle system 702C, a fourth vehicle system 702D, and a fifth vehicle system 702E, may travel along the first path in the first direction of travel. In the illustrated embodiment, the fifth vehicle system may be located outside of the segment, but will enter the segment before the end of the determined time period (e.g., before the end of the day). Three of the vehicle systems, including a sixth vehicle system 702F, a seventh vehicle system 702G, and an eighth vehicle system 702H, can travel along the second path in the second direction of travel.

According to one or more embodiments, the network controller can set a permitted PO/W limit for the vehicle systems that are scheduled to travel along the segment of the route during the determined time period. When the permitted PO/W limit is enforced, the vehicle systems avoid generating power outputs that would cause the actual power output per weight of the vehicle systems to exceed the permitted PO/W limit while the vehicle systems travel through the segment. The permitted PO/W limit can be a power-to-weight ratio and can be represented by available vehicle horsepower per ton (HPT). The permitted PO/W limit is less than a maximum achievable power output per weight (PO/W) of at least some of the vehicle systems. Therefore, the enforcement of the permitted PO/W may restrict the acceleration (and associated speed) of one or more of the vehicle systems by limiting the available throttle settings.

The network controller may set the permitted PO/W limit based on various factors including a determined PO/W limit, one or more route characteristics of the route, and/or the maximum achievable PO/W of one or more of the vehicle systems. The permitted PO/W limit may be set by the network controller using a calculation and/or a look-up table, analyzing received information and making a determination according to programmed instructions, or the like. Once the permitted PO/W limit is set, the network controller may communicate the permitted PO/W limit to the relevant vehicle systems using the communication device. For example, the network controller may generate a network message that includes the permitted PO/W limit, and the communication device may broadcast or transmit the network message to the vehicle systems.

In an embodiment, the network controller may set the permitted PO/W limit based on a determined PO/W limit. The determined PO/W limit may be selected without consideration of the characteristics of the vehicle systems or the characteristics of the route. For example, the determined PO/W limit may be selected by operator input, such as a dispatcher utilizing an input device. Alternatively, the determined PO/W limit may be accessed by the network controller from a database in a memory storage device. The database may include historical information such as network throughput data associated with different determined PO/W limits recorded during test cases and/or prior operations. The historical information may include a look-up table that identifies different PO/W limits, different route segments, and/or different network throughput data resulting from the PO/W limits at the route segments. The network controller may be programmed to select the PO/W limit in the look-up table will provide a determined network throughput (e.g., in number of vehicle systems over time) for the given segment of the route. The determined network throughput may be set by an operator or programmed as a default value into the program instructions of the network controller. Once the determined PO/W limit is determined, the network controller designates the determined PO/W limit as the permitted PO/W limit.

In an embodiment, the permitted PO/W limit may be specific to the vehicle systems scheduled to travel in the same direction and/or on the same path along the route. The two paths along the route can be separate and discrete, so the movement of vehicle systems along the first path may not have any effect on the movement of the vehicle systems along the second path, and vice-versa. The vehicle controller may set a first permitted PO/W limit to control the movement of the vehicle systems along the first path traveling in the first direction, and may set a second permitted PO/W limit to control the movement of the vehicle systems along the second path traveling in the second direction. Optionally, the vehicle controller may set a third permitted PO/W limit to control the movement of the vehicle systems scheduled to travel in the first direction along a third path that is parallel to the first path. The first and third paths may be lanes of a common paved highway, adjacent railroad tracks, or the like.

In a non-limiting example, the first path may be designated as a high-occupancy vehicle (HOV) lane, and the third path is designated for general traffic.

When the permitted PO/W limits are set based on maximum achievable PO/W of the vehicle systems, the network controller may only factor the maximum achievable PO/W of the specific vehicle systems scheduled to travel on the particular paths and/or in the particular directions. For example, the first permitted PO/W limit for the first path may be set based on the maximum achievable PO/W of each of the vehicle systems independent of or separate from the maximum achievable PO/W of the vehicle systems scheduled to travel on the second path in the opposite direction. Conversely, the second permitted PO/W limit may be set based on the maximum achievable PO/W of each of the vehicle systems independent of the maximum achievable PO/W of the vehicle systems.

FIG. 8 shows a table 800 including a first column 802 that lists the vehicle systems scheduled to travel along the segment of the route in the first direction of travel within the determined time period, a second column that lists the maximum achievable PO/W of the vehicle systems as HPT values, and a third column that ranks the HPT values from highest to lowest based on magnitude. In the illustrated embodiment, the first vehicle system has an HPT value of 2.0, the second vehicle system has a HPT value of 3.0, the third vehicle system has a HPT value of 2.5, the fourth vehicle system has a HPT value of 1.5, and the fifth vehicle system has a HPT value of 4.0. The network controller may determine the maximum achievable PO/W (e.g., HPT value) of the specific vehicle systems by accessing a database that contains such information or by requesting such information directly from the vehicle systems or another source. For example, a dispatch facility that generates the schedules for at least some of the vehicle systems may include a schedule database that includes vehicle-specific information including the maximum achievable PO/W about the vehicle systems. The network controller may access the schedule database and/or send a request for information about the vehicle systems to the dispatch facility.

According to one or more embodiments, once the maximum achievable PO/W of each of the vehicle systems are determined, the network controller can set the permitted PO/W limit for vehicles scheduled to travel along the path in the first direction based on the maximum achievable PO/W of these vehicle systems. For example, the network controller may rank the maximum achievable PO/W values of the vehicle systems in order based on magnitude. The third column of the table 800 shows that the fifth vehicle system has the highest (or greatest) maximum achievable PO/W limit with an HPT of 4.0 and is ranked number 1. The fourth vehicle system has the lowest maximum achievable PO/W limit with an HPT of 1.5 and is ranked number 5. The ranking in the third column represents an ordered distribution of the maximum achievable PO/W values of the vehicle systems.

The permitted PO/W limit for the vehicle systems traveling on the path may be set as a function based on the distribution. For example, in an embodiment, the network controller is programmed to select the lowest maximum achievable PO/W in the distribution as the permitted PO/W limit. According to the table 800, the HPT of 1.5 is set as the permitted PO/W limit because 1.5 is the lowest HPT value. After setting the permitted PO/W limit, the network controller may communicate the permitted PO/W limit to the vehicle systems 702A-E via the communication device. The vehicle systems implement the permitted PO/W limit by not exceeding the permitted PO/W limit while the each of vehicle systems travels through the segment of the route. Therefore, once the first vehicle system on the path enters the segment across the first end, the first vehicle system restricts the throttle settings to prevent generating power outputs that would cause the first vehicle system to exceed the HPT value of 1.5. Although the permitted PO/W limit is less than the maximum achievable PO/W of the vehicle systems 702A, 702B, 702C, and 702E, enforcing the permitted PO/W limit on the vehicle systems as the vehicle systems travel along the segment of the route may increase vehicle throughput along the segment (relative to not enforcing the permitted PO/W limit on the vehicle systems). For example, without the permitted PO/W limit, the fifth vehicle system with an HPT value of 4.0 could quickly catch up to the fourth vehicle system with the lower HPT of 1.5. The fifth vehicle system may have to slow down considerably to avoid traveling too close to the fourth vehicle. Over the length of the segment multiple such starting and stopping events of the fifth vehicle system may reduce the throughput of the route by causing other vehicles behind the fifth vehicle system to also slow.

In another embodiment, the network controller can set the permitted PO/W limit based on the maximum achievable PO/W in the distribution that is closest to a pre-selected percentile. In a non-limiting example, the pre-selected percentile is the 25th percentile. Because the distribution in FIG. 8 includes five HPT values, the fourth greatest HPT value (e.g., second lowest HPT value) represents the 20th percentile which is closest to the pre-selected 25th percentile. The first vehicle system may have the fourth greatest HPT value according to the ranking. Therefore, the network controller may set the permitted PO/W limit based on the maximum achievable PO/W of the first vehicle system. The first vehicle system may have an HPT value of 2.0, so the network controller may set the permitted PO/W limit to be a HPT value of 2.0. In this embodiment, the permitted PO/W limit at an HPT value of 2.0 is greater than if the permitted PO/W limit is based on the lowest maximum achievable PO/W, which is a HPT value of 1.5. Therefore, except for the fourth vehicle system that is limited in capability, the other vehicle systems traveling in the first direction through the segment can generate power outputs that exceed an HPT value of 1.5 as long as the power outputs do not exceed an HPT value of 2.0. In an embodiment, if the fifth vehicle system catches up to the fourth vehicle system, such that the fifth vehicle system crosses a first proximity threshold relative to the fourth vehicle system, a controller (e.g., the vehicle controller and/or the trip planning controller) onboard the fifth vehicle system may pace the fifth vehicle system based on the power-to-weight ratio (e.g., a HPT of 1.5) of the fourth vehicle system to prevent the fifth vehicle system from traveling too close to the fourth vehicle system and requiring a mandated stopping order. In another example, the crossing of the proximity threshold between the fourth and fifth vehicle systems may be determined by an external signaling system that generates a block occupancy signal indicating that the block ahead of the fifth vehicle system is occupied by the fourth vehicle system.

Although the 25th percentile is used in the example above, other embodiments may select the permitted PO/W limit based on different pre-selected percentiles, such as 30th percentile, 40th percentile, 50th percentile, or the like. Furthermore, instead of selecting the lowest maximum achievable PO/W as the permitted PO/W limit, in other embodiments the second-lowest maximum achievable PO/W, third-lowest, fourth-lowest, or the like may be set as the permitted PO/W limit. In general, a higher permitted PO/W limit enables greater acceleration and faster speeds of the vehicle systems through the segment of the route relative to a lower permitted PO/W limit. The greater accelerations and speeds would not necessarily reduce overall travel times or throughput though, due to a greater likelihood of vehicle systems catching up to other vehicle systems and requiring mandated stops or slow orders to increase the distance between vehicle systems 702.

In another embodiment, the network controller may set the permitted PO/W limit based on a calculation utilizing the maximum achievable PO/W values of the vehicle systems. For example, the network controller may calculate one or more statistical metrics based on the maximum achievable PO/W values of the relevant vehicle systems. The statistical metrics may include mean, median, standard deviation, and/or the like. For example, the network controller may be programmed to set the permitted PO/W limit as the median of the maximum achievable PO/W values. In the illustrated embodiment, the HPT of 2.5 is the median value, as it is in the middle of the distribution. Thus, the network controller may set the permitted PO/W limit to be the HPT of 2.5. In another example, the network controller may calculate the mean or average of the maximum achievable PO/W values and use the average value as the permitted PO/W limit. In the illustrated embodiment, the average of the five HPT values is 3.0, so the network controller may set the permitted PO/W limit to be the HPT of 3.0. In other embodiments, the permitted PO/W limit may be generated according to other types of calculations utilizing the individual maximum achievable PO/W values of the vehicle systems.

Although FIG. 8 is specifically directed to the vehicle systems 702A-E that travel on the path, the network controller may set a different (e.g., second) permitted PO/W limit for the vehicle systems 702F-H scheduled to travel on the path based on the maximum achievable PO/W values of the vehicle systems 702F-H. For example, the network controller may designate the lowest HPT value as the permitted PO/W limit, select the HPT value closest to a pre-selected percentile, or calculate a median or average of the HPT values of the vehicle systems 702F-H. As described above, the network controller may also set different permitted PO/W limits for other vehicle systems scheduled to travel on different paths along the segment of the route (in either direction), such as different lanes in a multi-lane highway.

Figure 9:
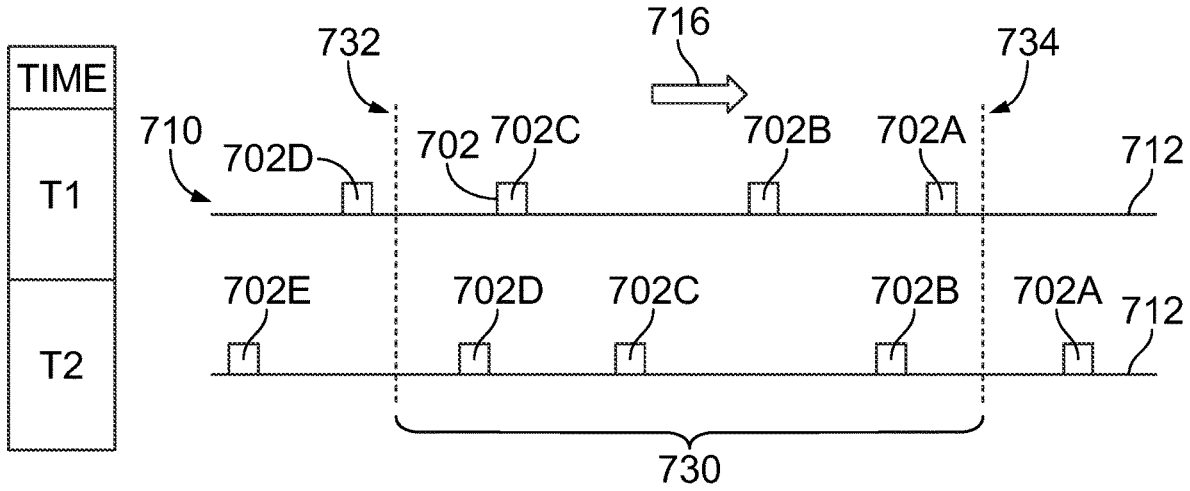
FIG. 9 is a schematic diagram showing the vehicle systems traveling along the route at two different times within a determined time period according to an embodiment.

FIG. 9 is a schematic diagram showing the vehicle systems traveling along the route at two different times within the determined time period according to an embodiment. The vehicle systems travel along the first path of the route in the first direction of travel. At the first time (e.g., T1), only three vehicle systems 702A, 702B, and 702C are commonly located on the segment of the route. For example, the fourth vehicle system has not yet reached the first end to enter the segment. At the second time (e.g., T2), which is subsequent to the first time, only vehicles 702B, 702C, and 702D are commonly located on the segment of the route. The first vehicle system has passed beyond the second end to exit the segment, and the fifth vehicle system has not yet reached the first end to enter the segment.

According to one or more embodiments, the network controller can dynamically update the permitted PO/W limit based on the specific vehicle systems that are commonly located on the segment of the route at a given time. For example, the permitted PO/W limit is based on the maximum achievable PO/W value of each of the vehicle systems scheduled to be located on the segment at the same time. For example, the permitted PO/W limit that is enforceable at time T1 is based on the maximum achievable PO/W values of the vehicle systems 702A, 702B, 702C only because these are the vehicle systems commonly located on the segment at time T1. The permitted PO/W limit that is enforced at time T1 may be independent of the maximum achievable PO/W values of the vehicle systems 702D and 702E that are scheduled to travel through the segment at a later time.

The network controller may update the permitted PO/W limit based on a change in the particular vehicle systems located on the segment. For example, the network controller may set an updated permitted PO/W limit once the network controller determines, based on the schedules of the vehicle systems or received messages, that the first vehicle system has passed the second end to exit the segment and/or that the fourth vehicle system has passed the first end to enter the segment. The updated permitted PO/W limit is enforced on the vehicles 702B, 702C, 702D traveling through the segment at the second time T2. The updated permitted PO/W limit may be based on the maximum achievable PO/W values of the vehicle systems 702B, 702C, 702D only because these are the vehicle systems commonly located on the segment at time T2.

In an embodiment, the network controller can set the updated permitted PO/W limit that will be enforced at time T2 to constrain the movement of the vehicle systems 702B, 702C, 702D commonly located on the segment of the route in advance. For example, the network controller may be able to determine the locations of the vehicle systems relative to the ends of the segment at different times based on the known schedules of the vehicle systems and/or from communications with the vehicle systems and/or with a dispatch center. At or around time T1, the network controller may be able to estimate the time at which the first vehicle system will exit the segment and/or the time at which the fourth vehicle system will enter the segment. If the first vehicle system exits around the same time as the fourth vehicle system enters, the network controller may assume that the two events occur at the same time and may set the updated permitted PO/W limit based on the maximum achievable PO/W values of the second, third, and fourth vehicle systems. The network controller may communicate the updated permitted PO/W limit to all the vehicle systems on the first path, or at least to the three vehicle systems 702B, 702C, 702D commonly located on the segment at time T2, prior to the first vehicle system exiting and/or the fourth vehicle system entering. Therefore, as soon as the estimated time at which the first vehicle system exits the segment and the fourth vehicle system enters the segment occurs, the three vehicle systems 702B, 702C, 702D on the segment can travel according to the updated permitted PO/W limit (instead of the original permitted PO/W limit). In an alternative embodiment, the network controller may periodically update the permitted PO/W limit at a designated interval instead of waiting until a vehicle system enters or exits the segment.

In an embodiment, the permitted PO/W limit that is most current and up-to-date is enforced by the vehicle systems while the vehicle systems travel on the segment of the route. For example, all the vehicle systems shown in FIG. 9 may enforce the most current permitted PO/W limit upon crossing the first end to enter the segment. The vehicle systems that are already on the segment when an updated permitted PO/W limit is received from the network controller may automatically enforce the updated permitted PO/W limit upon receipt of the updated permitted PO/W limit.

The permitted PO/W limit is enforced by the vehicle systems as a function of time, distance, and/or location along the route. For example, as described above, the permitted PO/W limit may automatically be enforced against (e.g., applied to) the vehicle systems upon the vehicle systems that travel on a specific path and/or direction of travel entering the segment of the route and/or receiving a message identifying the permitted PO/W limit. Alternatively, the enforcement of the permitted PO/W limit may be postponed such that one or more of the vehicle systems do not automatically implement the permitted PO/W limit upon receipt of or upon entering the segment. For example, the network controller may generate an enforcement schedule that prescribes one or more enforcement periods during which the permitted PO/W limit is enforced by the vehicle systems. The enforcement schedule may be communicated to the vehicle systems in the same message with the permitted PO/W limit or in different messages. The enforcement schedule may have different enforcement periods for different corresponding vehicle systems such that the enforcement periods are vehicle-specific. The enforcement periods may be characterized by time, location along the route, distance traveled along the route, or path along the route.

The network controller may generate the enforcement schedule based on a priori information about the movement of the vehicle systems, such as speed limits, designated schedules for the vehicle systems, slow orders, and/or the like. The schedules for the vehicle systems may indicate locations and times for planned stops. The network controller may utilize the enforcement schedule to control when the vehicle systems are constrained by the permitted PO/W limit. For example, the vehicle systems may be permitted to exceed the permitted PO/W limit outside of the enforcement periods prescribed by the enforcement schedule. Based on the a priori information about the movement of the vehicle systems, the network controller can estimate when a trailing vehicle system may approach a vehicle system ahead (referred to as a leading vehicle system), and can schedule an enforcement period at that time to constrain the movement of the trailing vehicle system and prevent the trailing vehicle system from traveling within a designated threshold distance of the leading vehicle system.

In an embodiment, the network controller may generate the enforcement schedule to postpone enforcing the permitted PO/W limit on one or more of the vehicle systems based on an amount of distance or headway between the respective vehicle system and an adjacent vehicle system on the same path of the route. In the illustrated embodiment, prior to the fourth vehicle system crossing the first end to enter the segment, the network controller may determine (e.g., estimate and/or calculate) an amount of headway between the fourth vehicle system and the third vehicle system in front of the fourth vehicle system on the path in the same direction of travel. In this example, the third vehicle system is a leading vehicle system and the fourth vehicle system is a trailing vehicle system that follows behind the leading vehicle system. There are no other vehicles on the path between the leading vehicle system and the trailing vehicle system.

The network controller may postpone enforcing the permitted PO/W limit on the trailing vehicle system 702D to allow the trailing vehicle system 702D to travel through at least a portion of the segment unrestrained by a power output limit. While the permitted PO/W limit is postponed, the trailing vehicle system 702D may travel through the segment limited only by regulatory constraints, such as speed limits, and inherent mechanical constraints, such as the maximum achievable PO/W of the trailing vehicle system 702D. Although the permitted PO/W limit may be postponed for the trailing vehicle system 702D, the permitted PO/W limit may be enforced against other vehicle systems on the segment of the route, such as the leading vehicle system 702C. The trailing vehicle system 702D may reduce the distance between the two vehicle systems 702C, 702D during the postponement because the power output of the leading vehicle system 702C may be limited by the PO/W limit.

The network controller may postpone the enforcement of the permitted PO/W limit on the trailing vehicle system 702D based on the amount of headway of the leading vehicle system 702C. For example, the greater the headway or distance separating the vehicle systems, the less likely the trailing vehicle system 702D will catch up to the leading vehicle system 702C if the permitted PO/W limit is postponed against the trailing vehicle system 702C. Inversely, the shorter the distance separating the vehicle systems, the more likely the trailing vehicle system 702D will be able to catch up to the leading vehicle system 702C if the permitted PO/W limit is postponed. Therefore, the network controller may determine an extent of the postponement, in terms of time or travel distance, based on the amount of headway of the leading vehicle system 702C. For example, the network controller may postpone enforcement of the permitted PO/W limit on the trailing vehicle system 702D for a longer amount of time and/or a greater travel distance of the trailing vehicle system 702D through the segment if the leading vehicle system 702C is thirty miles ahead than if the leading vehicle system 702C is fifteen miles ahead. The network controller 720 may also consider other factors, such as grade of the segment, the maximum achievable PO/W limit of the trailing vehicle system 702D, and/or the magnitude of the permitted PO/W limit when determining the extent of the postponement.

The network controller may dictate the enforcement schedule to the vehicle systems based on time, distance, and/or location along the route. For example, the enforcement schedule may indicate that the trailing vehicle system 702D does not need to implement the permitted PO/W limit until a designated amount of time has elapsed after the trailing vehicle system 702D enters the segment, until the trailing vehicle system 702D reaches a designated location along the segment (e.g., a mile marker or the like), or until the trailing vehicle system 702D travels a designated distance along the segment. After the designated time elapses, the designated location is reached, and/or the designated distance is traveled, the trailing vehicle system 702D can implement the permitted PO/W limit while traveling through the remainder of the segment, or until the enforcement period ends.

In another embodiment, the permitted PO/W limit may be postponed indefinitely until a trailing vehicle system catches up to a leading vehicle system on the same path moving in the same direction. For example, the trailing vehicle system may travel unrestrained by the permitted PO/W limit until the trailing vehicle system is determined to be within a designated threshold proximity of the leading vehicle system or until the trailing vehicle system encounters a block occupancy signal from an external signaling system that indicates that the block is currently occupied by the leading vehicle system. In response, the trailing vehicle system enforces the permitted PO/W limit to avoid narrowing the distance between the two vehicle systems.

Figure 10:
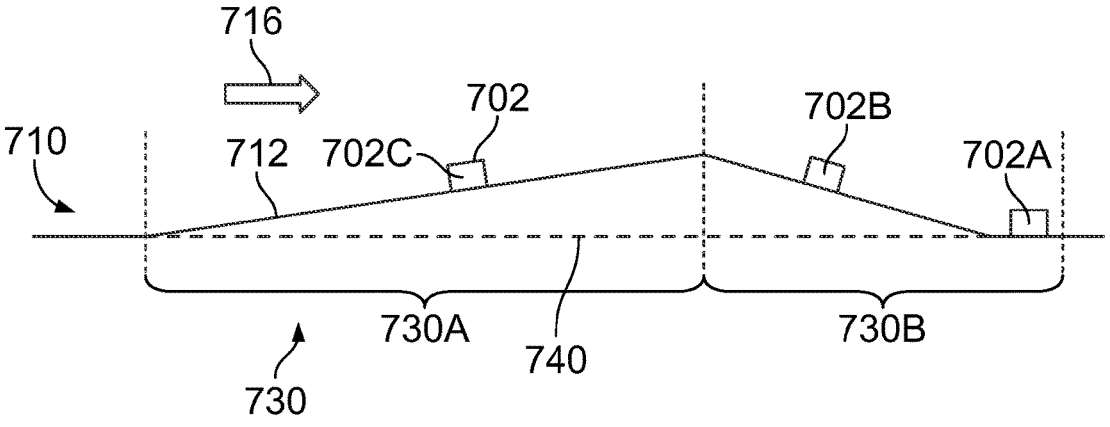
FIG. 10 is a schematic diagram showing three vehicle systems traveling through two different segments of the route within the determined time period according to an embodiment.

FIG. 10 is a schematic diagram showing three vehicle systems 702A-C traveling through two different segments 730A, 730B of the route within the determined time period according to an embodiment. The network controller may set the permitted PO/W limit based on the route characteristics of the route. The route characteristics may include grade, speed limit, curvature, friction, and/or the like. For example, the network controller may set a greater permitted PO/W limit for a first segment of a route than the permitted PO/W limit set for a second segment of the route if the first segment has a higher speed limit than the second segment. A higher speed limit would typically require a greater power output from the vehicle systems to achieve the speed limit than a lower speed limit. The network controller may set the permitted PO/W limit based on averages of one or more of the route characteristics, which accounts for temporary deviations over the length of the segment.

In FIG. 10, the network controller may set a first permitted PO/W limit for a first segment 730A of the route based on the grade of the first segment, and may set a second permitted PO/W limit for a second segment 730B of the route based on the grade of the second segment. The grade refers to the incline or decline of the route relative to a level plane 740. To set the permitted PO/W limits, the network controller may determine (e.g., calculate and/or estimate) the average grade of the segments. The average grade may be determined based on information received from a track database or calculated based on measurements from sensors, such as optical lasers. In the illustrated embodiment, the first segment along the path has an incline average grade in the direction of travel, such that the vehicle systems generally travel uphill along the first segment, and the second segment has a declined average grade in the direction of travel.

The network controller may set the permitted PO/W limits based on the average grades such that a greater permitted PO/W limit is set for segments that have an incline average grade than for segments that have a decline average grade. Furthermore, a greater permitted PO/W limit may be set for a first incline segment than a second incline segment, although both segments are inclined, if the first incline segment has a greater inclination than the second incline segment. For example, a segment of the route that traverses up a steep hill or mountain may have a high permitted PO/W limit or no PO/W limit at all. The vehicle systems traversing up steep segments are thus allowed to utilize a significant amount of the achievable tractive effort to ascend the hill or mountain. Limiting the power output (with a low permitted PO/W limit) may hinder the ability of the vehicle systems to ascend the hill or mountain.

In the illustrated embodiment, the first permitted PO/W limit set by the network controller for the first segment is greater than the second permitted PO/W limit set for the second segment. In a non-limiting example, the first permitted PO/W limit may have an HPT value of 3.5, and the second permitted PO/W limit may have an HPT value of 2.0. The first permitted PO/W limit is enforced by the vehicle systems when traversing the first segment, and the second permitted PO/W limit is enforced by the vehicle systems when traversing the second segment. For example, the first and second vehicle systems are on the second segment and so travels to avoid exceeding the second permitted PO/W limit (e.g., HPT of 2.0). The third vehicle system is on the first segment and so travels to avoid exceeding the first permitted PO/W limit. Although the third vehicle system can generate more power output than the second vehicle system due to the disparity in permitted PO/W limits, the third vehicle system is traveling along an incline grade and is unlikely to catch up to the second vehicle system that is traveling along a decline grade. The second permitted PO/W limit may be set relatively low due to the decline grade. For example, the relatively low permitted PO/W limit may restrain the acceleration of the second vehicle system along the decline to prohibit the vehicle system from catching up to the first vehicle system that is traveling on a level portion of the second segment. The third vehicle system will travel according to the lower, second permitted PO/W limit once the third vehicle system enters the second segment of the route.

In one embodiment, the network controller may set the permitted PO/W limits for the segments of the route based only on the route characteristics. For example, the network controller may consider the grade of the segments and potentially other factors, such as precipitation, friction, tilt, curvature, volume of anticipated traffic, road crossings, etc., when setting the permitted PO/W limit independent of the capabilities of the vehicle systems that are scheduled to travel along the route, such as the maximum achievable PO/W of the vehicle systems. In another embodiment, the network controller may set the permitted PO/W limits based on both the route characteristics (e.g., grade) of the route and the capabilities of the vehicle systems (e.g., maximum achievable PO/W). For example, if the network controller determines an HPT of 2.0 for a given segment of the route based on the maximum achievable PO/W of the vehicle systems scheduled to travel on the segment within a determined time period, the network controller may adjust the HPT value up or down depending on the grade of the segment 730. For example, if the grade is an incline, the network controller may set the permitted PO/W limit for the segment to be 2.5 or 3.0 instead of 2.0 to accommodate the additional power output necessary to propel the vehicle systems uphill.

Figure 11:
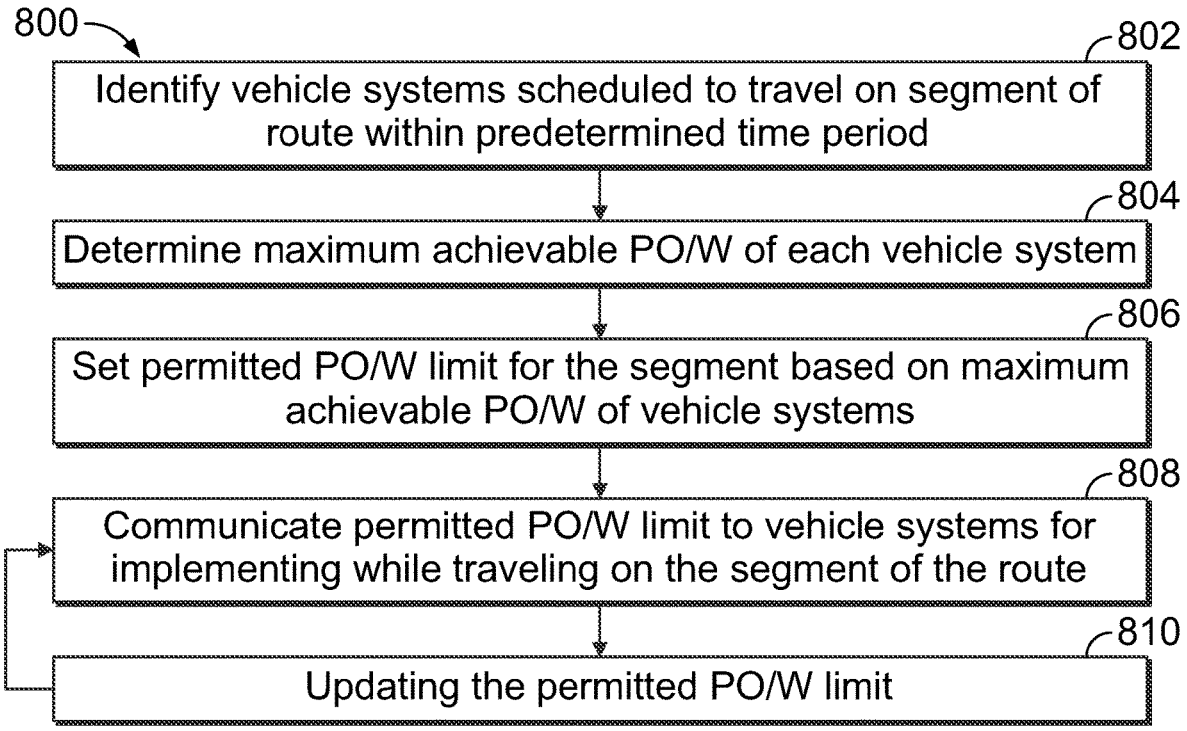
FIG. 11 is a flow chart of a method for controlling a network of plural vehicle systems scheduled to travel on a segment of a route within a determined time period according to an embodiment.

FIG. 11 is a flow chart of a method 800 for controlling a network of plural vehicle systems scheduled to travel on a segment of a route within a determined time period according to an embodiment. The method 800 can increase overall throughput of the route by restraining the acceleration capabilities of at least some of the vehicle systems to provide more uniform movement of the vehicle systems through the segment of the route. The method 800 may be performed in whole or in part by the network controller shown in FIG. 7, including the controller thereof. The method 800 may include additional steps, fewer steps, and/or different steps than the illustrated flowchart in FIG. 11.

With additional reference to FIGS. 7 through 10, at step 802, multiple vehicle systems scheduled to travel or traveling along a segment of a route within a determined time period are identified.

At step 804, a maximum or other upper level of achievable power output per weight (PO/W) of each of the vehicle systems is determined. The maximum achievable PO/W of each of the vehicle systems may be determined based on a network database and/or messages received from the vehicle systems.

At step 806, a permitted PO/W limit is set for the segment of the route based, at least in part, on the maximum achievable PO/W of one or more of the vehicle systems scheduled to travel on the segment of the route. The permitted PO/W limit is less than the maximum achievable PO/W of at least some of the vehicle systems. Optionally, setting the permitted PO/W limit may include ranking the maximum achievable PO/W of the vehicle systems in order from lowest to highest in a distribution, and using the particular maximum achievable PO/W in the distribution that is closest to a pre-selected percentile as the permitted PO/W limit. Optionally, setting the permitted PO/W limit may include determining the lowest maximum achievable PO/W out of the vehicle systems scheduled to travel along the segment of the route in a common direction of travel during the determined time period, and using that lowest maximum achievable PO/W as the permitted PO/W limit. Optionally, setting the permitted PO/W limit may include calculating an average or median of the maximum achievable PO/W of each of the vehicle systems scheduled to travel along the segment of the route during the determined time period.

At step 808, the permitted PO/W limit is communicated to the vehicle systems for the vehicle systems to implement the permitted PO/W limit while traveling on the segment of the route. The permitted PO/W limit may be wirelessly communicated from a location offboard the vehicle systems, such as a dispatch center, a wayside device, or the like. The vehicle systems may implement the permitted PO/W limit by not exceeding the permitted PO/W limit while the vehicle systems travel along the segment and the permitted PO/W limit is enforced. For example, if a throttle setting of 5 could cause a given vehicle system to generate a power output that exceeds the permitted PO/W limit, the given vehicle system does not implement the throttle setting 5 while the vehicle system travels through the segment and the permitted PO/W limit is enforced. The vehicle systems may implement the permitted PO/W limit to increase overall vehicle throughput along the route. Optionally, the permitted PO/W limit is enforced automatically by the vehicle systems in response to the vehicle systems entering the segment and/or receiving the permitted PO/W limit via a message.

Optionally, the method 800 may include scheduling enforcement of the permitted PO/W limit. For example, the method 800 may include determining an amount of headway between a trailing vehicle system (e.g., 702D shown in FIG. 9) of the vehicle systems and a leading vehicle system (e.g., 702C shown in FIG. 9) of the vehicle systems. The leading vehicle system travels along the route ahead of the trailing vehicle system in a same direction of travel. Enforcement of the permitted PO/W limit by the trailing vehicle system may be postponed for a scheduled duration (or distance of travel) based on the amount of headway. For example, the trailing vehicle system does not enforce the permitted PO/W limit until after the trailing vehicle system travels along the segment of the route for a designated length of time or a designated distance according to the enforcement schedule.

At step 810, the permitted PO/W limit is updated. For example, the permitted PO/W limit may be dynamically updated over time based on a change in the group of vehicle systems schedule to travel (or actively traveling) on the segment of the route. In an embodiment, the permitted PO/W limit is set at step 806 based on the maximum achievable PO/W of each vehicle system in a first group of vehicle systems scheduled to be commonly located on the segment during a first time period within the determined time period. For example, if the determined time period is an entire day, the first time period may be a duration of two hours during that day. The permitted PO/W limit may be set based on the particular vehicle systems scheduled to be on the segment during that two hour time window. The vehicle systems on the segment during that two hour time window implement the permitted PO/W limit. The permitted PO/W limit can be updated at step 810 to reflect a change in the particular vehicle systems on the segment of the route.

For example, an updated permitted PO/W limit may be set based on the maximum achievable PO/W of each vehicle system in a second group of vehicle systems scheduled to be commonly located on the segment during a second time period that is subsequent to the first time period. For example, the second time period may be a two hour window of time immediately after the first time period within the same day. The second group includes at least one different vehicle system than the first group, attributable to at least one additional vehicle system entering the segment and/or at least one vehicle system exiting the segment. After setting the update permitted PO/W, the method 800 can return to step 808 and the updated permitted PO/W limit is communicated to the vehicle systems. The vehicle systems may enforce or implement the updated permitted PO/W limit during the second time period.

In an embodiment, a system (e.g., a vehicle control system) is provided that includes a communication device and controller operably connected to the communication device. The communication device is located offboard multiple vehicle systems scheduled to travel along a segment of a route within a determined time period. The controller can set a permitted power output per weight limit for the vehicle systems. The permitted power output per weight limit is less than a maximum achievable power output per weight of at least some of the vehicle systems. The permitted power output per weight limit is set based on a determined power output per weight, one or more route characteristics of the segment of the route, and/or the maximum achievable power output per weight of one or more of the vehicle systems. The permitted power output per weight limit is enforced as a function of time, distance, and/or location along the route. The communication device can communicate the permitted power output per weight limit to the vehicle systems such that the vehicle systems traveling along the segment of the route do not exceed the permitted power output per weight limit while the permitted power output per weight limit is enforced.

The controller can set the permitted power output per weight limit based on the maximum achievable power output per weight of each of the vehicle systems scheduled to travel in a first direction along a first path of the route independent of the maximum achievable power output per weight of any of the vehicle systems scheduled to travel in an opposite, second direction along the route or scheduled to travel in the first direction along a different, second path of the route. The segment of the route may include multiple parallel paths on which vehicle systems travel in a first direction along the route. The permitted power output per weight limit can be a first permitted power output per weight limit that is set by the controller for the vehicle systems scheduled to travel on a first path of the multiple parallel paths. The controller can set a different, second permitted power output per weight limit for the vehicle systems scheduled to travel on a second path of the multiple parallel paths.

The controller may determine a lowest maximum achievable power output per weight out of the vehicle systems scheduled to travel along the segment of the route in a common path and direction of travel within the determined time period, and set the permitted power output per weight limit based on the lowest maximum achievable power output per weight. The controller can rank the maximum achievable power output per weight of the vehicle systems scheduled to travel along the segment of the route within the determined time period in order from lowest to highest in a distribution, and set the permitted power output per weight limit based on the maximum achievable power output per weight in the distribution that is closest to a pre-selected percentile. The controller may set the permitted power output per weight limit based on statistical metric of the maximum achievable power output per weight of the vehicle systems scheduled to travel along the segment of the route within the determined time period. The controller can set the permitted power output per weight limit based on the maximum achievable power output per weight of each of the vehicle systems scheduled to be commonly located on the segment of the route at a first time within the determined time period. Optionally, the controller can update the permitted power output per weight limit based on at least one of the vehicle systems entering or exiting the segment of the route.

The segment of the route may be a first segment of the route and the permitted power output per weight limit is a first permitted power output per weight limit that is set based on an average grade of the first segment. The controller can set a second permitted power output per weight limit based on an average grade of a second segment of the route. The communication device can communicate the first and second permitted power output per weight limits to the vehicle systems such that the vehicle systems do not exceed the first permitted power output per weight limit when traversing the first segment of the route and do not exceed the second permitted power output per weight limit when traversing the second segment of the route. The controller can set the permitted power output per weight limit based on the route characteristics of the segment of the route. The route characteristics may include grade, speed limit, friction, and/or curvature. The controller can set the permitted power output per weight limit based on the grade such that a greater permitted power output per weight limit is set for a segment having an incline average grade than for a segment having a decline average grade.

The communication device can communicate an enforcement schedule to the vehicle systems with the permitted power output per weight limit. The enforcement schedule may prescribe one or more enforcement periods in which the permitted power output per weight limit is enforced by the vehicle systems. The one or more enforcement periods can be characterized by time, location along the route, direction of travel, distance traveled, and/or path along the route. Optionally, the controller can determine the enforcement schedule based at least on schedules of the vehicle systems.

The controller may determine an amount of headway between a trailing vehicle system of the vehicle systems and a leading vehicle system of the vehicle systems that travels along the segment of the route ahead of the trailing vehicle system in a same direction of travel. The controller can postpone enforcing the permitted power output per weight limit on the trailing vehicle system for an amount of time or a distance of travel of the trailing vehicle system along the segment of the route based on the amount of headway. The controller and the communication device may be commonly located at a dispatch center or a wayside device.

In one or more embodiments, a method is provided that can include identifying multiple vehicle systems scheduled to travel along a segment of a route within a determined time period and determining a maximum achievable power output per weight of each of the vehicle systems. The method may include setting a permitted power output per weight limit for the segment of the route. The permitted power output per weight limit can be less than the maximum achievable power output per weight of at least some of the vehicle systems and is set based on the maximum achievable power output per weight of one or more of the vehicle systems. The method may include communicating the permitted power output per weight limit to the vehicle systems such that the vehicle systems do not exceed the permitted power output per weight limit while the vehicle systems travel along the segment of the route and the permitted power output per weight limit is enforced.

The maximum achievable power output per weight of each of the vehicle systems can be determined based on a network database and/or messages received from the vehicle systems. Setting the permitted power output per weight limit can be based on ranking the maximum achievable power output per weight of the vehicle systems scheduled to travel along the segment of the route during the determined time period in order from lowest to highest in a distribution.

The route may include a first path and a second path. The permitted power output per weight limit can be a first permitted power output per weight limit that may be set based on the maximum achievable power output per weight of a first group of the vehicle systems scheduled to travel on the first path. The method may further include setting a second permitted power output per weight limit based on the maximum achievable power output per weight of a second group of the vehicle systems scheduled to travel on the second path.

The permitted power output per weight limit can be set based on the maximum achievable power output per weight of each vehicle system in a first group of vehicle systems scheduled to be commonly located on the segment of the route during a first time period within the determined time period. The permitted power output per weight limit can be communicated to the vehicle systems for enforcement during the first time period. The method may further include setting an updated permitted power output per weight limit based on the maximum achievable power output per weight of each vehicle system in a second group of vehicle systems scheduled to be commonly located on the segment of the route during a second time period subsequent to the first time period. The second group can include at least one different vehicle system than the first group. The method can include communicating the updated permitted power output per weight limit to the vehicle systems for enforcement during the second time period.

The method may include determining an amount of headway between a trailing vehicle system of the vehicle systems and a leading vehicle system of the vehicle systems. The leading vehicle system can travel along the route ahead of the trailing vehicle system in a same direction of travel. The method may include scheduling enforcement of the permitted power output per weight limit by the trailing vehicle system based on the amount of headway.

In one or more embodiments, a system is provided that may include a controller having one or more processors. The controller can identify multiple vehicle systems scheduled to travel along a segment of a route within a determined time period and determine a maximum achievable power output per weight of each of the vehicle systems. The controller can set a permitted power output per weight limit for the segment of the route. The permitted power output per weight limit may be set based on the maximum achievable power output per weight of one or more of the vehicle systems and is less than the maximum achievable power output per weight of at least some of the vehicle systems. The system also may include a communication device operably connected to the network controller. The communication device can communicate the permitted power output per weight limit to the vehicle systems such that the vehicle systems implement the permitted power output per weight limit while traveling along the segment of the route.

In an embodiment, a system includes a locator device, a communication circuit, and controller. The locator device may be disposed onboard a trailing vehicle system that can travel along a route behind a leading vehicle system that travels along the route in a same direction of travel as the trailing vehicle system. The locator device can determine a location of the trailing vehicle system along the route. The communication circuit may be disposed onboard the trailing vehicle system. The communication circuit can repeatedly receive a status message that includes a location of the leading vehicle system. The controller can be onboard the vehicle system and may be connected to the locator device and the communication circuit. The controller can verify that a power-to-weight ratio of the leading vehicle system is less than a power-to-weight ratio of the trailing vehicle system. The power-to-weight ratios of the leading vehicle system and the trailing vehicle system can be based on respective upper power output limits of the leading and trailing vehicle systems. The controller can monitor a trailing distance between the trailing vehicle system and the leading vehicle system based on the respective locations of the leading and trailing vehicle systems. Responsive to the trailing distance being less than a first proximity distance relative to the leading vehicle system, the controller may set an upper permitted power output limit for the trailing vehicle system that is less than the upper power output limit of the trailing vehicle system to reduce an effective power-to-weight ratio of the trailing vehicle system.

The controller can set the upper permitted power output limit for the trailing vehicle system such that the effective power-to-weight ratio of the trailing vehicle system based on the upper permitted power output limit is no greater than the power-to-weight ratio of the leading vehicle system. The trailing vehicle system may include at least one propulsion system that provides tractive effort to move the trailing vehicle system along the route. The power-to-weight ratio of the trailing vehicle system can represent a total available tractive effort that can be provided by the at least one propulsion system divided by a total weight of the trailing vehicle system. The communication circuit may receive the status message that includes the location of the leading vehicle system from at least one of the leading vehicle system, a dispatch location, or an aerial device. Responsive to the trailing distance being less than a first proximity distance, the controller can set the upper permitted power output limit for the trailing vehicle system by restricting throttle settings used to control propulsion of the trailing vehicle system to exclude at least a top throttle setting that is associated with the upper power output limit of the trailing vehicle system.

The controller may control the movement of the trailing vehicle system along an upcoming section of the route according to the upper permitted power output limit such that a power output of the trailing vehicle system for propelling the trailing vehicle system along the route does not exceed the upper permitted power output limit.

The controller can continue monitoring the trailing distance subsequent to setting the upper permitted power output limit of the trailing vehicle system. Responsive to the trailing distance being greater than a second proximity distance relative to the leading vehicle system, the controller may increase the upper permitted power output limit of the trailing vehicle system such that the effective power-to-weight ratio of the trailing vehicle system that results is greater than the power-to-weight ratio of the leading vehicle system. The second proximity distance can extend farther from the leading vehicle system than the first proximity distance. Optionally, the controller may increase the upper permitted power output limit to an adjusted upper permitted power output limit that is at least one of equal to or less than the upper power output limit of the trailing vehicle system.

The first proximity distance can extend rearward from the leading vehicle system to a first proximity threshold. The controller may determine that the trailing distance is less than the first proximity distance responsive to a designated portion of the trailing vehicle system being more proximate to the leading vehicle system than a proximity of the first proximity threshold to the leading vehicle system.

The controller of the trailing vehicle system may determine the power-to-weight ratio of the leading vehicle system by at least one of retrieving the power-to-weight ratio of the leading vehicle system from storage in a memory onboard the trailing vehicle system or by the communication circuit receiving the power-to-weight ratio in a message from at least one of the leading vehicle system or a dispatch location. The controller of the trailing vehicle system can determine the power-to-weight ratio of the trailing vehicle system by at least one of retrieving the power-to-weight ratio of the leading vehicle system from storage in a memory onboard the trailing vehicle system or by the communication circuit receiving the power-to-weight ratio in a message from a dispatch location.

In another embodiment, a method (e.g., for controlling movement of a trailing vehicle system) may include determining a power-to-weight ratio of a leading vehicle system that is on a route and disposed ahead of a trailing vehicle system on the route in a direction of travel of the trailing vehicle system. The method can include verifying that the power-to-weight ratio of the leading vehicle system is less than a power-to-weight ratio of the trailing vehicle system. The power-to-weight ratios of the leading vehicle system and the trailing vehicle system may be based on respective upper power output limits of the leading and trailing vehicle systems. The method also can include monitoring a trailing distance between the trailing vehicle system and the leading vehicle system along the route. The method may further include, responsive to the trailing distance being less than a first proximity distance relative to the leading vehicle system, setting an upper permitted power output limit that is less than the upper power output limit. An effective power-to-weight ratio of the trailing vehicle system based on the upper permitted power output limit may be no greater than the power-to-weight ratio of the leading vehicle system.

The method can further include controlling the movement of the trailing vehicle system along an upcoming section of the route according to the upper permitted power output limit. The movement may be controlled according to the upper permitted power output limit such that a power output of the trailing vehicle system for propelling the trailing vehicle system along the route does not exceed the upper permitted power output limit. The power-to-weight ratio of the leading vehicle system can be received onboard the trailing vehicle system in a message that is received by a communication circuit of the trailing vehicle system. The trailing distance may be monitored by periodically receiving a status message that includes an updated location of the leading vehicle system and comparing the updated location of the leading vehicle system to a current location of the trailing vehicle system determined via a locator device onboard the trailing vehicle system.

Responsive to the trailing distance being less than a first proximity distance, the upper permitted power output limit of the trailing vehicle system can be set by restricting throttle settings used to control propulsion of the trailing vehicle system to exclude at least a top throttle setting that is associated with the upper power output limit of the trailing vehicle system. The method may further include monitoring the trailing distance subsequent to setting the upper permitted power output limit of the trailing vehicle system. Responsive to the trailing distance being greater than a second proximity distance relative to the leading vehicle system, the method can include increasing the upper permitted power output limit of the trailing vehicle system such that the effective power-to-weight ratio of the trailing vehicle system that results is greater than the power-to-weight ratio of the leading vehicle system. The second proximity distance may extend farther from the leading vehicle system than the first proximity distance. Optionally, the upper permitted power output limit can be increased to an adjusted upper permitted power output limit that is at least one of equal to or less than the upper power output limit of the trailing vehicle system.

The first proximity distance may extend rearward from the leading vehicle system to a first proximity threshold. The trailing distance can be determined to be less than the first proximity distance responsive to a designated portion of the trailing vehicle system being disposed between the first proximity threshold and the leading vehicle system. The first proximity distance can be greater than a sum of at least a safe braking distance for the trailing vehicle system and a response time distance for the trailing vehicle system.

Figure 12:
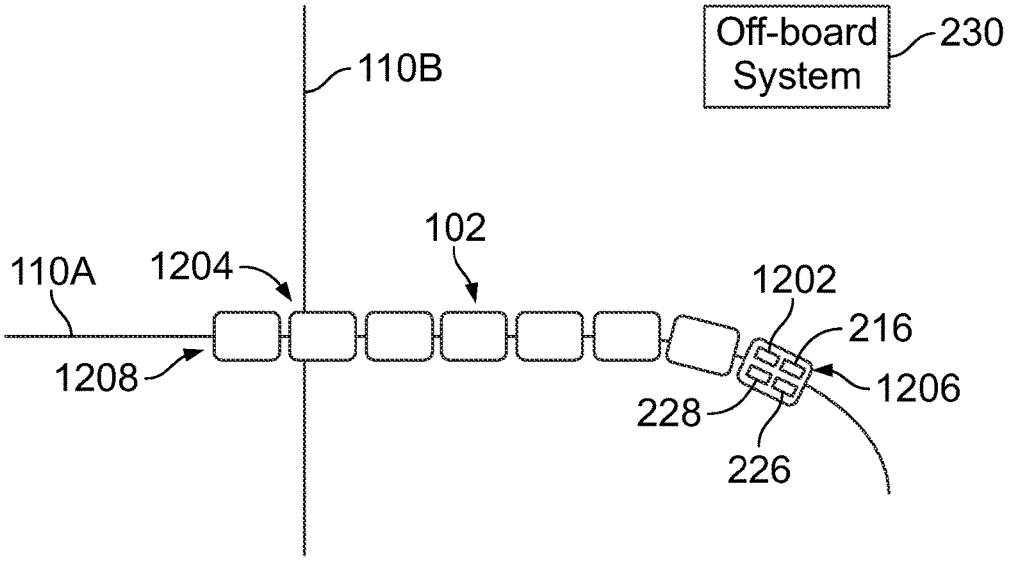
FIG. 12 illustrates another example of a vehicle control system.

FIG. 12 illustrates another example of a vehicle control system 1200. The vehicle control system may include a controller 1202 that represents one or more of the controllers described herein. The vehicle control system also may include the locator device, the clock, and the memory described above. While these components are shown as being disposed onboard the same vehicle in the multi-vehicle system shown in FIG. 12, optionally, two or more of these components may be disposed onboard two or more different vehicles in the vehicle system (and may communicate with each other via wired and/or wireless connections).

The vehicle system may travel on a route that crosses, merges, or otherwise intersects with another route at an intersection or crossing 1204 (the crossing is not visible in FIG. 12 due to the vehicle system being located in the crossing, but the crossing is located at the intersection between routes). For example, the vehicle system may be moving along a first route 110A that meets a second route 110B at the intersection or crossing. Optionally, three or more routes may meet at the same intersection or crossing. These routes may be for the same type of vehicle system or for different types of vehicle systems. The first route may be a track for a rail vehicle system and the second route may be a road for automobiles, trucks, buses, etc. As another example, both routes may be tracks, both routes may be roads, etc. And, in one embodiment, there may be plural intersections along one or more routes.

The controller can communicate with and use these components to determine whether the vehicle system is blocking the intersection and, optionally, for how long the vehicle system has been blocking the intersection. If the vehicle system is blocking the intersection or has been blocking the intersection for longer than a designated duration or time period, one or more responsive actions may be implemented. The vehicle system may block the intersection while the vehicle system is in a location that prevents another vehicle or vehicle system from passing through the intersection. For example, the vehicle system may block the intersection while at least one vehicle in the vehicle system is positioned to prevent another vehicle from passing through the intersection on the other route 110B and/or while at least one vehicle in the vehicle system is positioned to prevent another vehicle from passing through the intersection on the same route 110A.

The vehicles in the multi-vehicle system may be mechanically coupled with each other (e.g., by couplers) or may be separate from each other. With respect to the vehicles being separate from each other, in one example, the vehicles may communicate with each other to coordinate movements so that the vehicles move together (e.g., as a convoy). In another example, the separate vehicles may not coordinate their movements with each other but may communicate with each other to determine whether any of the vehicles are blocking the intersection. This may occur, for example, with several automobiles being stopped in traffic or due to an accident with one or more of the automobiles blocking the intersection.

In operation, the controller can determine a location of the vehicle system. For example, the controller can receive a geographic location or data indicative of the geographic location of the locator device or locating device onboard the vehicle system. But, because the locator device may be in a location that is away from the crossing while the vehicle system still blocks the crossing, the location of the locator device alone may not be sufficient for the controller to decide whether the vehicle system is blocking the intersection.

The controller can identify, determine, or obtain a size of the vehicle system. The size of the vehicle system may be a length of the vehicle system. In one embodiment, the size may be determined from the memory and may indicate a total distance from a front or leading end 1206 of the vehicle system to an opposite trailing or back end 1208 of the vehicle system. Optionally, the size may be determined from the memory and may indicate a locator distance from the position of the locator device onboard the vehicle system to the trailing or back end of the vehicle system. In such a situation, the locator distance may be shorter than the total distance as the locator device may not be disposed at the very front or leading end of the vehicle system. For example, if the locator device is disposed onboard the vehicle at the leading or front end of the vehicle system, then the total length of the vehicle system may be used as the size of the vehicle system. If the locator device is disposed elsewhere (e.g., the middle of the vehicle system), then the locator distance from the locator device to the trailing or back end of the vehicle system may be used as the size of the vehicle system. In one embodiment, the vehicle system's size may change dynamically over the course of a trip. The controller would then recalculate based on the then-current size. Also, for some system that are dynamically groupable, the controller may break vehicle groups into sub groups so as to span (without blocking) plural intersections, or may simply span one intersection with the gap between subgroups aligned with the intersection.

The controller may obtain a location of the intersection from the memory. For example, the memory may store locations of crossings or intersections, layouts or shapes of the routes, or the like. The controller can obtain the location of the intersection from the memory to determine whether the vehicle system is blocking the intersection. If the route on which the vehicle system is located is straight or linear (as determined from the memory), then the controller can use the location of the locator device and this size to determine whether the vehicle system is blocking the crossing. For example, if the distance between the locator device and the back or trailing end of the vehicle system is longer than the distance between the locator device and the intersection, then the controller can decide that the vehicle system is blocking the intersection. If the distance between the locator device and the back or trailing end of the vehicle system is shorter than the distance between the locator device and the intersection, then the controller can decide that the vehicle system is not blocking the intersection. As another example, if the distance between the locator device and the back or trailing end of the vehicle system is shorter than a percentage of the distance between the locator device and the intersection (e.g., 80%, 90%, 95%, etc., to provide room for error or clearance for other vehicles), then the controller can determine that the vehicle system is not blocking the intersection.

The controller may obtain a layout of the route on which the vehicle system is located. The layout may be stored in the memory and may represent a shape of the route. For example, the layout of a route may indicate curved sections (with or without radii of curvature of the curved sections), linear sections, etc. of the route, as well as where those sections are located. The layout optionally may include grades of the route. The controller can use the route layout along with the size that is determined to decide whether the vehicle system is or is not blocking the intersection. For example, the same vehicle system may be blocking an intersection where the route on which the vehicle system is located is linear, but may not block the intersection where the route on which the vehicle system is located has one or more curved sections. The controller may compare the length of the vehicle system with the route layout to determined whether the length of the vehicle along the shape of the route results in the vehicle system blocking or being present in the intersection.

The controller can calculate how long the vehicle system has been blocking the intersection. In one example, the controller can use the clock to measure how long the vehicle system has been blocking the intersection. The controller may begin measuring this time once the vehicle system is blocking the intersection (even if the vehicle system continues to be moving) or may begin measuring this time once the vehicle system is determined to be blocking the intersection and is stationary.

The controller may compare the duration or time period that the vehicle system is or has been blocking the intersection (e.g., a blocking time period) with a threshold duration or threshold time period. If this blocking duration or blocking time period is longer than the threshold duration or time period, then the controller may implement one or more responsive actions. If the blocking time period is not longer than the threshold duration or period of time, then the controller may not yet implement the responsive action(s).

One example of the responsive action may include generating an alert to warn an operator of the vehicle system. This alert may be generated using the display onboard the vehicle system, the emitter device (or another sound generating device, such as a speaker or horn), a mobile phone, or the like. The alert can notify the operator of the blocking of the crossing and can prompt the operator to move the vehicle system out of the crossing. The alert may be generated onboard the vehicle system (for operators that are onboard the vehicle systems) or off-board the vehicle system (for operators that are remotely controlling the vehicle systems).

As another example, the responsive action can include communicating an alert or alert signal to the off-board system, such as an off-board vehicle control system. As described above, the vehicle control system can monitor locations of vehicle systems and communicate signals granting or withholding permission to enter different route segments. The signal sent to the off-board system can be used by the off-board system (e.g., a controller of the off-board system) to determine whether to prevent other vehicle systems from passing through or heading toward the intersection that is blocked (while the vehicle system blocks the intersection). For example, the off-board system may direct other vehicle systems to slow down or stop before reaching the blocked intersection, to take other routes or paths that do not extend through the blocked intersection, or the like (such as by issuing movement authorities to these other vehicle systems).

Another responsive action that may be implemented may include notifying the off-board system that the vehicle system is blocking the intersection and then receiving a request signal from the off-board system to verify whether the vehicle system is blocking the intersection. For example, the location, size, and route layout may be used to decide that the vehicle system is blocking the intersection when, in fact, the vehicle system is not blocking the intersection. This can occur due to errors in the location that was determined, the size of the vehicle system, the layout of the route, etc. The request signal may direct an operator of the vehicle system to visually determine whether the vehicle system is blocking the intersection (e.g., by disembarking from the vehicle system and looking at the intersection, by viewing the intersection via display of one or more camera feeds, etc.). The operator can then confirm that the vehicle system is or is not blocking the intersection, and the controller can communicate this information back to the off-board system for use (e.g., in routing other vehicles toward or away from the intersection as appropriate).

As another example, the off-board system may receive a notification from the vehicle system (e.g., the controller) that the crossing is blocked (e.g., for longer than the threshold duration), and may send a signal to the controller to move the vehicle system. The controller may then instruct the operator or may autonomously move the vehicle system in either direction so that the vehicle system is no longer blocking the intersection or crossing.

Figure 13:
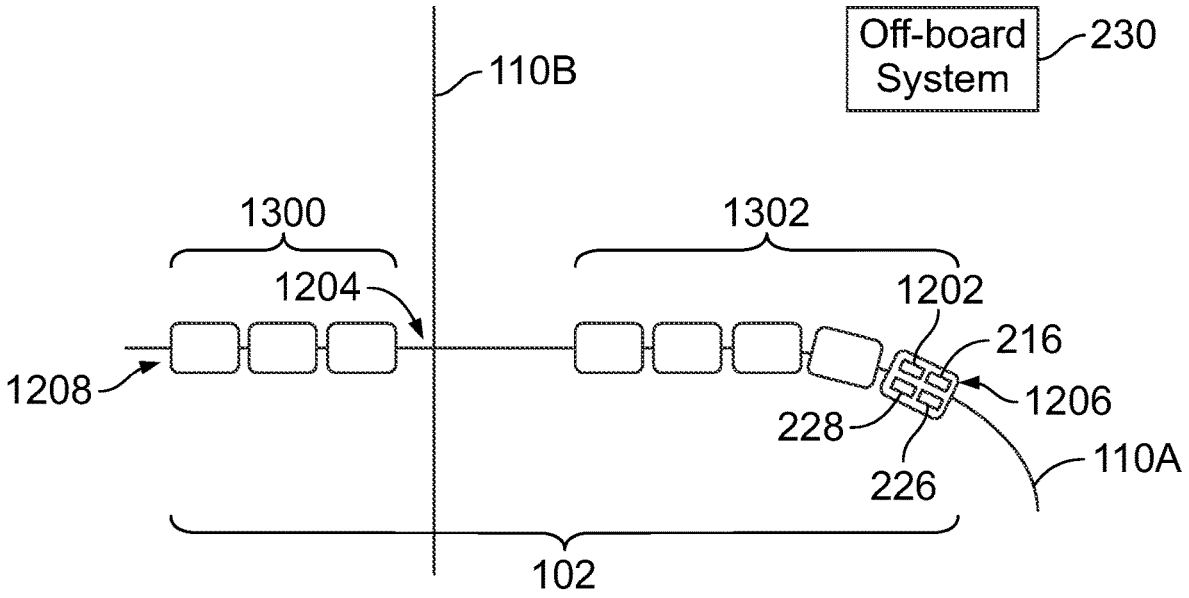
FIG. 13 illustrates one example of splitting the vehicle system apart to stop blocking the intersection.

As another example of a responsive action, the controller and/or the off-board system may direct the vehicle system to split apart and at least partially move to stop blocking the intersection. For example, the vehicle system may include several propulsion-generating vehicles in different locations. The vehicle system may be split apart (e.g., by disconnecting a coupler, by directing disconnected segments of the vehicle system to move in opposite directions away from each other, etc.). FIG. 13 illustrates one example of splitting the vehicle system apart to stop blocking the intersection. As shown, the last three vehicles in the vehicle system may be separated from the first five vehicles of the vehicle system. These last three vehicles may be a trailing or back segment 1300 of the vehicle system, and the first five vehicles may be a leading or front segment 1302 of the vehicle system. The trailing segment and the leading segment may each include at least one propulsion-generating vehicle, and each may be referred to as a smaller vehicle system (with each one including a single vehicle or multiple vehicles). The propulsion-generating vehicle in the trailing segment may move the trailing segment away from the leading segment, and the propulsion-generating vehicle in the leading segment may move the leading segment away from the trailing segment, so that the crossing or intersection is no longer blocked.

As another example of a responsive action that may be implemented by the controller or the off-board system, an alert may be sent to the off-board system, which can represent a first responder system. For example, the off-board system may be or may include a dispatch facility or system for firefighters, police, ambulances, etc. The off-board system may receive the alert that the crossing is blocked, and in the event of an emergency, can direct or route first responders around the blocked intersection. This can prevent the first responders from being blocked from reaching the location of the emergency by the blocked intersection.

Figure 14:
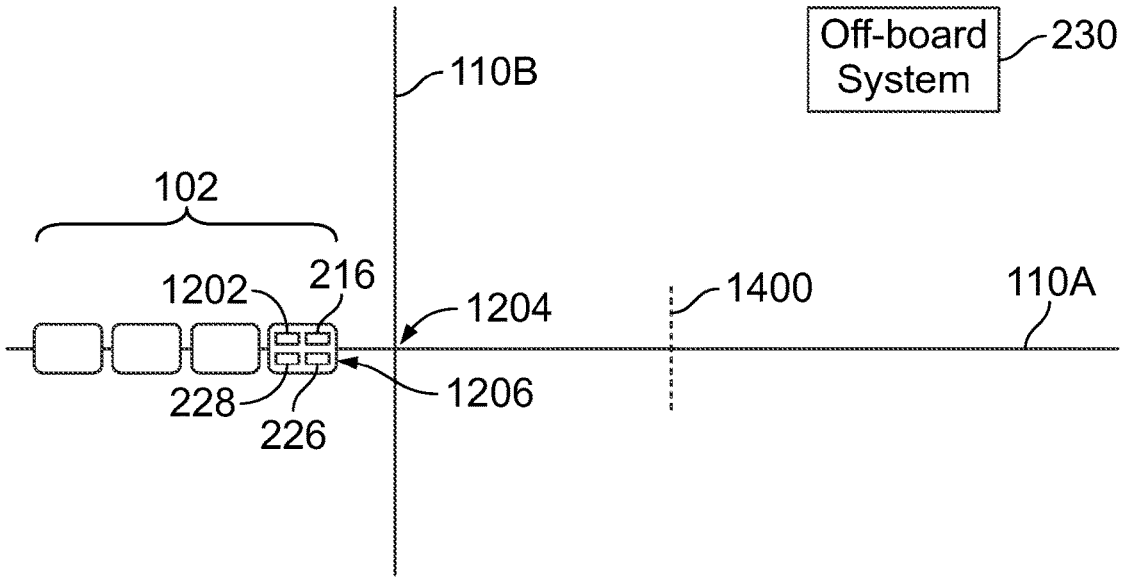
FIG. 14 illustrates another example of operation of the control system.

FIG. 14 illustrates another example of operation of the control system. In FIG. 14, the vehicle system is headed toward or through the intersection and may be slowing to a stop. The controller can forecast or predict a stop location 1400 where the front end of the vehicle system is expected to be located once the vehicle system stops moving (and is stationary). This stop location can be calculated based on the moving speed of the vehicle system (e.g., obtained from a sensor, the locator device, etc.), the weight and/or size of the vehicle system (e.g. obtained from the memory), the layout of the route (e.g., the grade of the route, as obtained from the memory), the braking effort or force being exerted (e.g., obtained from one or more sensors), a braking curve (e.g., obtained from the memory), or the like. Once the stop location is estimated, calculated, forecasted, or predicted, the controller can determine whether the vehicle system will block the intersection once stopped. This determination can be performed as described above (e.g., by comparing the size of the vehicle system with the location of the intersection). One or more of the responsive actions described above may be implemented if it is determined that the vehicle system will block the intersection. Optionally, the controller may prevent the vehicle system from stopping at the predicted stop location. For example, the controller may increase the speed and/or reduce the braking force being exerted to cause the vehicle system to stop farther away from the intersection. As another example, the controller may reduce the speed further and/or increase the braking force being exerted to cause the vehicle system to stop before reaching (and blocking) the intersection.

Figure 15:
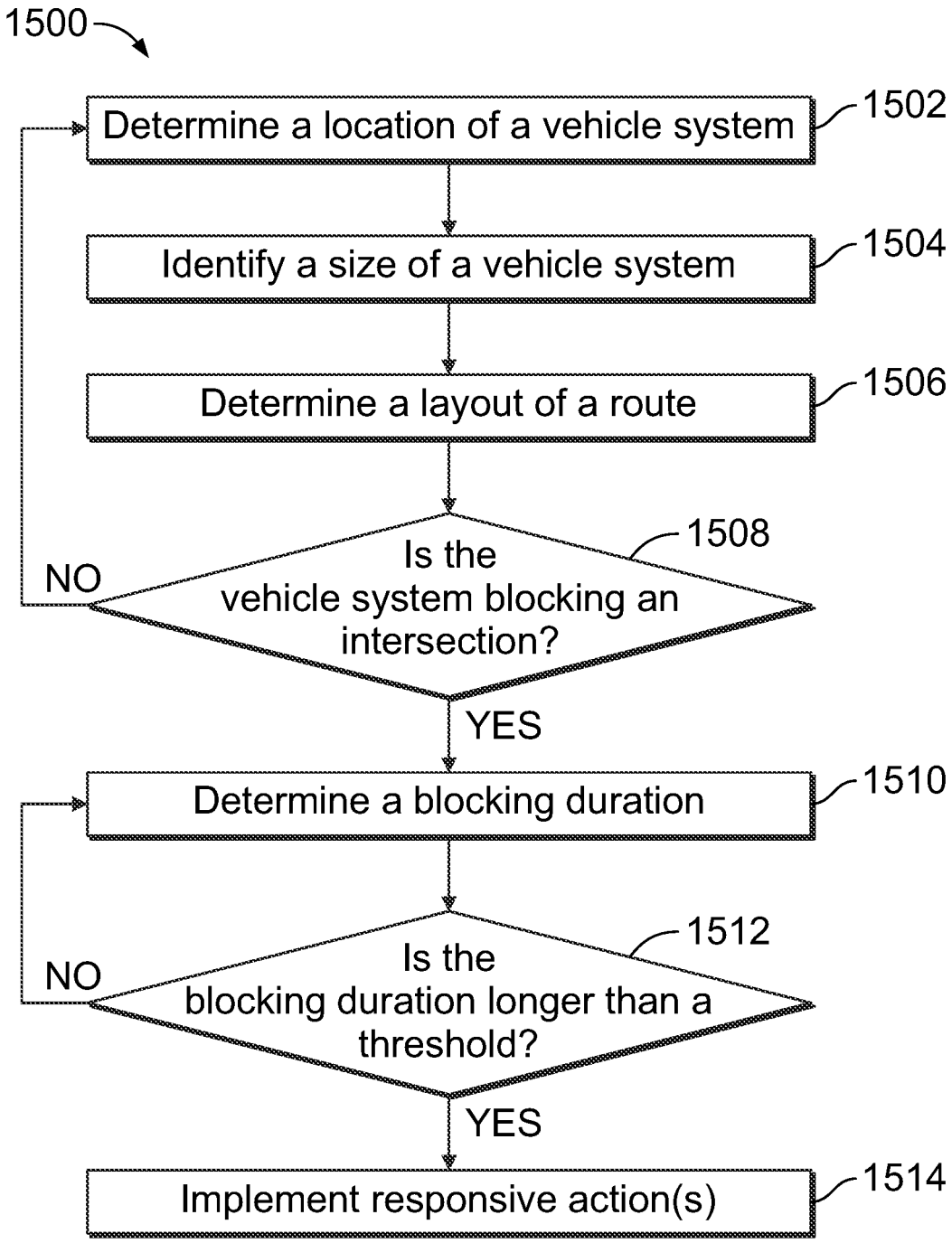
FIG. 15 illustrates a flowchart of one example of a method for controlling a vehicle system.

FIG. 15 illustrates a flowchart of one example of a method 1500 for controlling a vehicle system. The method can represent operations performed to prevent the vehicle system from blocking the intersection. The method can represent operations performed by the controller and/or the off-board system, as described above. At step 1502, a location of the vehicle system is determined. At step 1504, a size of the vehicle system is determined, such as a total length of the vehicle system, a length or distance from a locating or locator device that determined the location of the vehicle system and a back or trailing end of the vehicle system, or the like. At step 1506, a layout or shape of the route on which the vehicle system is located is determined. At step 1508, a decision is made as to whether the vehicle system is blocking an intersection. This decision can be made based on the location that is determined, the size of the vehicle system, the location of the intersection, and/or the layout of the route. If the vehicle system is determined to be blocking the intersection, then flow of the method can proceed toward step 1510. Otherwise, flow of the method can return to another step (e.g., step 1502) or may terminate.

At step 1510, a duration or length of time that the vehicle system has been blocking the intersection is determined. This duration can be measured from the time at which the vehicle system first blocks the intersection or from the time at which it is determined that the vehicle system is blocking the intersection. At step 1512, a decision is made as to whether the vehicle system has been blocking the intersection for longer than a designated threshold duration or length of time. If the vehicle system has been blocking the intersection for longer than the threshold, then flow of the method can proceed toward step 1514. Otherwise, flow of the method can return toward another step (e.g., step 1510) or may terminate. At step 1514, one or more responsive actions are implemented, as described above. Flow of the method may then terminate or return to another step.

In one embodiment, the controllers or systems described herein may have a local data collection system deployed and may use machine learning to enable derivation-based learning outcomes. The controllers may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used making determinations, calculations, comparisons and behavior analytics, and the like.

In one embodiment, the controllers may include a policy engine that may apply one or more policies. These policies may be based at least in part on characteristics of a given item of equipment or environment. With respect to control policies, a neural network can receive input of a number of environmental and task-related parameters. These parameters may include, for example, operational input regarding operating equipment, data from various sensors, location and/or position data, and the like. The neural network can be trained to generate an output based on these inputs, with the output representing an action or sequence of actions that the equipment or system should take to accomplish the goal of the operation. During operation of one embodiment, a determination can occur by processing the inputs through the parameters of the neural network to generate a value at the output node designating that action as the desired action. This action may translate into a signal that causes the vehicle to operate. This may be accomplished via backpropagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes, which may be weighed relative to each other.

In one example, a method is provided that may include determining a location of a locating device disposed onboard a vehicle system, identifying a size of the vehicle system, calculating a duration that the vehicle system has been blocking or will be blocking an intersection between at least two intersecting routes based at least in part on the location of the locating device and on the size of the multi-vehicle system, and implementing one or more responsive actions to clear the intersection responsive to the calculation of the duration.

The method also may include obtaining a layout of the route on which the vehicle system is disposed. Calculating the duration may also be based at least in part on the layout of the route. Calculating the duration also may be based at least in part on a speed of the vehicle system. The intersection can be one of a plurality of intersections and the duration that is calculated may be based at least in part on the blocking of two or more intersections of the plurality of intersections. For example, instead of just determining whether a single intersection is blocked, the system or method can determine whether the vehicle system or group of disconnected vehicles are stopped or otherwise positioned to block multiple intersections.

The action can include one or more of generating an alert for an operator of the vehicle system, actuating a wayside signaling device to impose an obstacle across at least one route through the intersection (e.g., by lowering a gate to prevent the vehicle system from moving further or to prevent other vehicles on another route from entering the intersection), controlling a speed of the vehicle system or another vehicle system (e.g., speeding up or slowing down the vehicle system to prevent blockage of the intersection), re-routing at least one vehicle or vehicle system approaching the intersection temporally proximate to the duration (e.g., directing the vehicle system onto another route to avoid blocking the intersection and/or directing another vehicle or vehicle system onto another route to avoid the blocked intersection). The responsive action(s) may include communicating an alert to an off-board vehicle control system that determines and communicates movement authorities to restrict where the vehicle system and one or more other vehicles systems are allowed to travel. The responsive action(s) may include receiving a command from the off-board vehicle control system to obtain a verification that the multi-vehicle system is blocking the intersection.

The responsive action(s) may include receiving a command from the off-board vehicle control system to move the vehicle system out of the intersection, receiving a command from the off-board vehicle control system to split the multi-vehicle system into two or more smaller multi-vehicle systems on either side of the intersection without blocking the intersection, communicating an alert to an off-board first responder system that coordinates dispatching of first responder personnel to emergency locations, and/or communicating an alert to one or more other vehicle systems to direct the one or more other vehicle systems to change movement to avoid reaching the intersection while the vehicle system is in the intersection.

The location of the locating device that is determined may be spaced apart from the intersection. The duration that the vehicle system has been blocking the intersection may occur while the multi-vehicle system is slowing toward a stop, and the method also can include forecasting a stop location where the locating device will be located once the vehicle system stops moving based on a moving speed of the vehicle system and a braking force exerted by the vehicle system, determining whether the vehicle system will block the intersection based on the stop location that is forecasted and the size of the vehicle system, and causing or allowing the vehicle system to advance until the vehicle system no longer blocks the intersection responsive to determining that the vehicle system will block the intersection based on the stop location that is forecasted and the size of the vehicle system.

In another example, a vehicle control system is provided and may include a controller that can identify a size of a multi-vehicle system and to calculate a duration that the multi-vehicle system has been blocking or will block an intersection between routes based on both of a location of a locating device disposed on a vehicle within the multi-vehicle system and on the size of the multi-vehicle system. The controller can implement one or more responsive actions to clear the intersection or to maintain the intersection as clear during the duration.

The controller may obtain a layout of the route in the routes on which the multi-vehicle system is disposed, and can calculate the duration based at least in part one or more of the location of the locating device, the size of the multi-vehicle system, and the layout of the route on which the multi-vehicle system is disposed. The controller can generate a signal that affects a speed or a route of another vehicle approaching the intersection during the duration. The controller may calculate the duration based on a speed of the multi-vehicle system. The controller can control a speed of the multi-vehicle system based at least in part on a achieving a determined duration. The controller may communicate an alert to an off-board vehicle control system that determines and communicates movement authorities to restrict where the multi-vehicle system and one or more other vehicles systems are allowed to travel as the one or more responsive actions.

In another example, a method is provided that can include forecasting a stop location where a locating device will be located once a multi-vehicle system stops moving based at least in part on a moving speed of the multi-vehicle system and a braking force exerted by the multi-vehicle system, determining whether the multi-vehicle system will block an intersection between intersecting routes based at least in part on the stop location that is forecasted, and a size of the multi-vehicle system, and preventing the multi-vehicle system from stopping or allowing the multi-vehicle system to continue moving until the multi-vehicle system does not block or will no longer block the intersection responsive to determining that the multi-vehicle system will block the intersection based on the stop location that is forecasted and the size of the multi-vehicle system.

The foregoing description of certain embodiments of the present inventive subject matter will be understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, the terms "system," "device," or "unit" may include a hardware and/or software system that operates to perform one or more functions. For example, a unit, device, or system may include a computer processor, controller, or other logic-based device that performs operations based on instructions stored on a tangible and non-transitory computer readable storage medium, such as a computer memory. Alternatively, a unit, device, or system may include a hard-wired device that performs operations based on hard-wired logic of the device. The units, devices, or systems shown in the attached figures may represent the hardware that operates based on software or hardwired instructions, the software that directs hardware to perform the operations, or a combination thereof. The systems, devices, or units can include or represent hardware circuits or circuitry that include and/or are connected with controller, such as one or computer microprocessors.

Other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A method, comprising:

determining a location of a locating device disposed onboard a vehicle system;

identifying a size of the vehicle system;

calculating a duration that the vehicle system has been blocking or will be blocking an intersection between at least two intersecting routes based at least in part on the location of the locating device and on the size of the multi-vehicle system; and implementing one or more responsive actions to clear the intersection responsive to the calculation of the duration.

2. The method of claim 1, further comprising obtaining a layout of the route on which the vehicle system is disposed, and wherein calculating the duration further is based at least in part on the layout of the route.

3. The method of claim 1, wherein calculating the duration further is based at least in part on a speed of the vehicle system.

4. The method of claim 1, wherein the intersection is one of a plurality of intersections and the duration that is calculated is based at least in part on the blocking of two or more intersections of the plurality of intersections.

5. The method of claim 1, wherein the one or more responsive actions include one or more of:

generating an alert for an operator of the vehicle system, actuating a wayside signaling device to impose an obstacle across at least one route through the intersection, controlling a speed of the vehicle system, controlling a speed of at least one other vehicle system, and re-routing at least one vehicle or vehicle system approaching the intersection temporally proximate to the duration.

6. The method of claim 1, wherein the one or more responsive actions include communicating an alert to an off-board vehicle control system that determines and communicates movement authorities to restrict where the vehicle system and one or more other vehicles systems are allowed to travel.

7. The method of claim 6, wherein the one or more responsive actions also include receiving a command from the off-board vehicle control system to obtain a verification that the multi-vehicle system is blocking the intersection.

8. The method of claim 6, wherein the one or more responsive actions also include receiving a command from the off-board vehicle control system to move the vehicle system out of the intersection.

9. The method of claim 6, wherein the one or more responsive actions also include receiving a command from the off-board vehicle control system to split the multi-vehicle system into two or more smaller multi-vehicle systems on either side of the intersection without blocking the intersection.

10. The method of claim 1, wherein the one or more responsive actions include communicating an alert to an off-board first responder system that coordinates dispatching of first responder personnel to emergency locations.

11. The method of claim 1, wherein the one or more responsive actions include communicating an alert to one or more other vehicle systems to direct the one or more other vehicle systems to change movement to avoid reaching the intersection while the vehicle system is in the intersection.

12. The method of claim 1, wherein the location of the locating device that is determined is spaced apart from the intersection.

13. The method of claim 1, wherein the duration that the vehicle system has been blocking the intersection occurs while the multi-vehicle system is slowing toward a stop, and the method further comprises:

forecasting a stop location where the locating device will be located once the vehicle system stops moving based on a moving speed of the vehicle system and a braking force exerted by the vehicle system;

determining whether the vehicle system will block the intersection based on the stop location that is forecasted and the size of the vehicle system; and causing or allowing the vehicle system to advance until the vehicle system no longer blocks the intersection responsive to determining that the vehicle system will block the intersection based on the stop location that is forecasted and the size of the vehicle system.

14. The vehicle control system of claim 13, wherein the controller is configured:

to obtain a layout of the route in the routes on which the multi-vehicle system is disposed; and to calculate the duration based at least in part one or more of the location of the locating device, the size of the multi-vehicle system, and the layout of the route on which the multi-vehicle system is disposed.

15. The vehicle control system of claim 13, wherein the controller is configured to generate a signal that affects a speed or a route of another vehicle approaching the intersection during the duration.

16. The vehicle control system of claim 13, wherein the controller is configured to calculate the duration based on a speed of the multi-vehicle system.

17. The vehicle control system of claim 13, wherein the controller is configured to control a speed of the multi-vehicle system based at least in part on a achieving a determined duration.

18. The vehicle control system of claim 13, wherein the controller is configured to communicate an alert to an off-board vehicle control system that determines and communicates movement authorities to restrict where the multi-vehicle system and one or more other vehicles systems are allowed to travel as the one or more responsive actions.

19. A vehicle control system, comprising:

a controller configured:

to identify a size of a multi-vehicle system;

to calculate a duration that the multi-vehicle system has been blocking or will block an intersection between routes based on both of a location of a locating device disposed on a vehicle within the multi-vehicle system and on the size of the multi-vehicle system; and to implement one or more responsive actions to clear the intersection or to maintain the intersection as clear during the duration.

20. A method, comprising:

forecasting a stop location where a locating device will be located once a multi-vehicle system stops moving based at least in part on a moving speed of the multi-vehicle system and a braking force exerted by the multi-vehicle system;

determining whether the multi-vehicle system will block an intersection between intersecting routes based at least in part on the stop location that is forecasted, and a size of the multi-vehicle system; and preventing the multi-vehicle system from stopping or allowing the multi-vehicle system to continue moving until the multi-vehicle system does not block or will no longer block the intersection responsive to determining that the multi-vehicle system will block the intersection based on the stop location that is forecasted and the size of the multi-vehicle system.

* * * * *